US009556639B2

(12) United States Patent
Hunt et al.

(10) Patent No.: US 9,556,639 B2
(45) **Date of Patent: *Jan. 31, 2017**

(54) FRAME AND ROOF SYSTEM FOR A PORTABLE SHELTER

(71) Applicant: Sunjoy Industries Group Ltd., Steubenville, OH (US)

(72) Inventors: David Lewis Hunt, Cincinnati, OH (US); Gilbert Carl Schmidt, Walton, KY (US); Sean Michael Banal, Galena, OH (US); Lianzhang Pan, Huzhou (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/276,097

(22) Filed: May 13, 2014

(65) Prior Publication Data

US 2015/0144169 A1 May 28, 2015

Related U.S. Application Data

(63) Continuation-in-part of application No. 14/091,644, filed on Nov. 27, 2013.

(51) Int. Cl.
*E04H 15/18* (2006.01)
*E04B 7/00* (2006.01)
(Continued)

(52) U.S. Cl.
CPC ..... *E04H 15/18* (2013.01); *E04B 7/00* (2013.01); *E04H 15/16* (2013.01); *E04H 15/34* (2013.01); *E04H 15/48* (2013.01)

(58) Field of Classification Search
CPC ..... E04H 15/48; E04H 15/34; E04H 15/44; E04H 15/32; E04H 15/008; E04B 7/00; E04B 7/16
(Continued)

(56) References Cited

U.S. PATENT DOCUMENTS 2,265,479 A 12/1941 Goodman
3,333,373 A 8/1967 Taylor et al.
(Continued)

OTHER PUBLICATIONS

Use and Care Guide for Lansing Gazebo, Hampton Bay, manufactured by Sunjoy Industries, pp. 1-9, dated Oct. 2002.
(Continued)

*Primary Examiner* — Winnie Yip
(74) *Attorney, Agent, or Firm* — The Law Office of Patrick F. O'Reilly III, LLC

(57) ABSTRACT

A portable shelter framing system is disclosed herein. The portable shelter framing system includes a plurality of corner support members; a plurality of crossbeam members, each of the crossbeam members configured to be connected between a pair of the plurality of corner support members without the use of tools; and a plurality of roof frame members, each of the roof frame members configured to be coupled to one of the plurality of corner support members or one of the plurality of crossbeam members without the use of tools. In one or more embodiments, the portable shelter framing system further includes a plurality of connecting members, each of the connecting members configured to couple a respective one of the plurality of roof frame members to a respective one of the plurality of corner support members or to a respective one of the plurality of crossbeam members without the use of tools.

20 Claims, 32 Drawing Sheets

(51) Int. Cl.
*E04H 15/48* (2006.01)
*E04H 15/34* (2006.01)
*E04H 15/16* (2006.01)

(58) Field of Classification Search
USPC ..... 135/121, 122, 147, 157–159, 905, 151,135/143–144; 52/63, 82, 91.1, 93.1, 92.1, 52/79.12, 79.1
See application file for complete search history.

(56) References Cited

U.S. PATENT DOCUMENTS

| | | | |
|---|---|---|---|
| 3,952,463 | A | 4/1976 | Lane |
| 4,066,089 | A | 1/1978 | Rainwater |
| 4,229,915 | A | 10/1980 | Snow et al. |
| 4,558,713 | A | 12/1985 | Hagler et al. |
| 4,726,153 | A | 2/1988 | Adler et al. |
| 4,733,508 | A | 3/1988 | Greenblatt |
| 4,914,768 | A | 4/1990 | Howard |
| 4,948,289 | A | 8/1990 | Dellinger |
| 5,226,440 | A | 7/1993 | Fuhrman |
| 5,511,572 | A | 4/1996 | Carter |
| 5,579,796 | A | 12/1996 | Mallo et al. |
| 5,632,293 | A | 5/1997 | Carter |
| 5,661,942 | A | 9/1997 | Palmer |
| 5,779,386 | A | 7/1998 | Eichhorn |
| 6,089,247 | A | 7/2000 | Price |
| 6,173,726 | B1 | 1/2001 | Talmadge |
| 6,200,060 | B1 | 3/2001 | Vernay |
| 6,206,020 | B1 | 3/2001 | Lynch |
| 6,216,717 | B1 | 4/2001 | Chen |
| 6,651,685 | B2 | 11/2003 | Connelly et al. |
| 6,745,521 | B1 | 6/2004 | Klemming |
| 6,761,181 | B1 | 7/2004 | Tseng |
| 6,772,780 | B2 | 8/2004 | Price |
| 6,814,094 | B1 | 11/2004 | Barber |
| 6,820,629 | B2 | 11/2004 | Tseng |
| 6,923,195 | B2 | 8/2005 | Tseng |
| 7,025,074 | B2 | 4/2006 | Porter |
| 7,207,344 | B2 | 4/2007 | Wu |
| 7,219,681 | B1 | 5/2007 | Hamilton-Jones |
| 7,451,776 | B2 | 11/2008 | Chen |
| 7,703,469 | B2 | 4/2010 | Danziger |
| 7,814,723 | B2 | 10/2010 | VanElverdinghe |
| 7,921,864 | B2 | 4/2011 | Carter |
| 8,001,986 | B2 | 8/2011 | Shumate |
| 8,082,938 | B2 | 12/2011 | Prusmack |
| 2006/0266401 | A1 | 11/2006 | Wu |
| 2011/0308559 | A1 | 12/2011 | Ma et al. |
| 2012/0240970 | A1 | 9/2012 | Parsons et al. |

OTHER PUBLICATIONS

Owner's Manual for Bay Window Gazebo, Garden Oasis Living Outdoors, manufactured by Sunjoy Industries, pp. 1-9, dated Oct. 2006.

11' x 13' South Hampton Gazebo Instruction Manual, manufactured by Sunjoy Industries, pp. 1-8, dated Oct. 2004.

11' x 13' New Port Gazebo Instruction Manual, manufactured by Sunjoy Industries, pp. 1-7, dated Oct. 2012.

Detail "A"

Detail "B"

Detail "C"

Detail "E"

Detail "F"

Detail "G"

Detail "H"

Detail "I"

Detail "J"

Detail "K"

Detail "L"

Detail "M"

Section A-A

FRAME AND ROOF SYSTEM FOR A PORTABLE SHELTER

CROSS-REFERENCE TO RELATED APPLICATIONS

This patent application is a continuation-in-part application, which is co-pending with, and claims priority from, U.S. Non-Provisional patent application Ser. No. 14/091,644, entitled "Frame and Roof System for a Portable Shelter", filed on Nov. 27, 2013, which is incorporated by reference herein in its entirety by this reference thereto.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to portable shelter framing systems. More particularly, the invention relates to portable shelter framing systems that are configured to be assembled without the use of tools.

2. Background and Description of Related Art

Portable shelters, such as outdoor gazebos, are useful for a myriad of different applications. For example, portable gazebos are often used for outdoor parties, such as backyard cookouts or tailgate parties at various sporting events. Because the portable gazebos are at least partially enclosed, a food serving table or tables are often placed inside of the gazebo to protect the food being served at the event from sunlight, rain, and/or insects. Also, dining tables may be arranged underneath the portable gazebo so that attendees at the party may remain cooler by being shaded from direct sunlight. Because portable gazebos are typically only used for a certain duration of time (e.g., during a tailgate party or backyard party) and/or are often set up in a remote, temporary location (e.g., in the parking lot of a stadium), it is often necessary to assemble and disassemble the portable structure each time that it is utilized. In addition, even if the portable shelter is used in the backyard of the owner thereof, it still is often desirable to assemble and disassemble the portable structure each time that it is utilized in order to protect it from damage due to the elements of the outdoor environment (e.g., wind, rain, snow, etc.). As such, it is highly preferable that such portable shelters can be quickly and easily assembled and disassembled so that the users thereof are not spending an inordinate amount of time setting up for their events.

Although, conventional portable shelters often require a great deal of time to assemble and disassemble because they include a large collection of constituent components that must be fastened together using a plurality of different tools. Not only is the assembly of these conventional portable shelters time consuming, but it is also inconvenient, the users of such shelters are required to carry around a variety of different tools each time they want to assemble their portable shelter in a remote location. Also, if they accidently forget to bring one of the tools that is necessary to assemble the portable shelter, they may be precluded from assembling the shelter at all.

Therefore, what is needed is a portable shelter framing system that can be quickly and easily assembled and disassembled each time that it is used. Also, a portable shelter framing system is needed that is capable of being assembled and disassembled without the use of any tools. In addition, a portable shelter framing system is needed that is capable of being disassembled into a plurality of compact components that do not occupy a large amount of space when the portable shelter is transported and stored.

BRIEF SUMMARY OF EMBODIMENTS OF THE INVENTION

Accordingly, the present invention is directed to a portable shelter framing system that substantially obviates one or more problems resulting from the limitations and deficiencies of the related art.

In accordance with one or more embodiments of the present invention, there is provided a portable shelter framing system, which includes: a plurality of folding corner frame members; a plurality of crossbeam members, each of the crossbeam members configured to be connected between a pair of the plurality of folding corner frame members without the use of tools; and a plurality of roof frame members, each of the roof frame members configured to be coupled to one of the plurality of folding corner frame members or one of the plurality of crossbeam members without the use of tools.

In a further embodiment of the present invention, the portable shelter framing system further comprises one or more shelf members, each of the one or more shelf members configured to be coupled to a respective one of the plurality of folding corner frame members without the use of tools.

In yet a further embodiment, the portable shelter framing system further comprises a plurality of corner connector members, each of the plurality of corner connector members configured to couple a respective one of the plurality of roof frame members to a respective one of the plurality of folding corner frame members.

In still a further embodiment, each of the plurality of corner connector members comprises a roof frame sleeve for receiving an end portion of a respective one of the plurality of roof frame members.

In yet a further embodiment, each of the plurality of corner connector members comprises one or more downwardly extending members, and each of the plurality of folding corner frame members comprises an aperture disposed in a top surface thereof; and wherein each aperture in the top surface of a respective one of the plurality of folding corner frame members is configured to receive a respective one of the one or more downwardly extending members of each corner connector member.

In still a further embodiment, one or more of the plurality of crossbeam members comprises a roof frame connector member for receiving an end portion of a respective one of the plurality of roof frame members.

In yet a further embodiment, the roof frame connector member diagonally extends from a side of the crossbeam member.

In still a further embodiment, each of the plurality of crossbeam members has opposed first and second end portions with one or more hook members; wherein each of the plurality of folding corner frame members has outer side edges with one or more respective slots disposed therein; and wherein each of the one or more hook members is configured to engage with a respective one of the one or more slots in one of the outer side edges of the folding corner frame member.

In accordance with one or more other embodiments of the present invention, there is provided a portable shelter framing system, which includes: a plurality of corner support assemblies; a plurality of crossbeam members, at least some of the crossbeam members configured to be connected between a pair of the plurality of corner support assemblies without the use of tools; and a plurality of roof frame members, each of the roof frame members configured to be coupled to one of the plurality of corner support assemblies or one of the plurality of crossbeam members without the use of tools.

In a further embodiment of the present invention, each of the plurality of corner support assemblies comprises spaced apart apertures disposed at the top thereof, each of the spaced apart apertures configured to receive a respective downwardly extending portion of one of the plurality of roof frame members.

In yet a further embodiment, each of the plurality of corner support assemblies comprises a center section and folding side sections disposed on opposite sides of the center section, each of the folding side sections configured to fold against the center section for compact storage of the portable shelter framing system.

In still a further embodiment, each of the spaced apart apertures is generally disposed at a location where one of the folding side sections adjoins the center section.

In yet a further embodiment, each of the plurality of corner support assemblies comprises a pair of spaced apart support posts.

In still a further embodiment, each of the spaced apart apertures is disposed in an upper end of a respective one of the spaced apart support posts.

In yet a further embodiment, each of the plurality of corner support assemblies further comprises a center fence section and side fence sections disposed on opposite sides of the center fence section, each of the center fence section and the side fence sections configured to be coupled to the spaced apart support posts without the use of tools.

In still a further embodiment, the portable shelter framing system further comprises a plurality of roof frame extension members, each of the roof frame extension members comprising the downwardly extending portion that is configured to be received in one of the spaced apart apertures of one of the plurality of corner support assemblies, and each of the roof frame extension members configured to couple a respective one of the plurality of roof frame members to a respective one of the plurality of corner support assemblies.

In yet a further embodiment, each of the plurality of roof frame extension members comprises a collar portion for receiving an end portion of a respective one of the plurality of roof frame members.

In accordance with yet one or more other embodiments of the present invention, there is provided a portable shelter framing system, which includes: a plurality of corner support members; a plurality of crossbeam members, each of the crossbeam members configured to be connected between a pair of the plurality of corner support members without the use of tools; a plurality of roof frame members, each of the roof frame members configured to be circumferentially spaced apart from one another so as to form a supporting structure for a roof material; and a plurality of connecting members, a first set of the plurality of connecting members configured to couple respective ones of the plurality of roof frame members to a respective ones of the plurality of corner support members without the use of tools, and a second set of the plurality of connecting members configured to couple respective ones of the plurality of roof frame members to a respective ones of the plurality of crossbeam members without the use of tools.

In a further embodiment of the present invention, each of the plurality of connecting members includes a body portion having an aperture disposed therethrough and a shaft portion connected to the body portion, the aperture of the body portion configured to receive one of the plurality of roof frame members therein, and the shaft portion configured to be inserted into a receiving aperture in one of the plurality of crossbeam members or into a corner insert member coupled to one of the plurality of corner support members.

In yet a further embodiment, the shaft portion of each of the plurality of connecting members includes a circumferential groove, each of the plurality of connecting members configured to be securely coupled to one of the plurality of crossbeam members or to the corner insert member by means of a tool-less fastener engaging the circumferential groove of the shaft portion.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
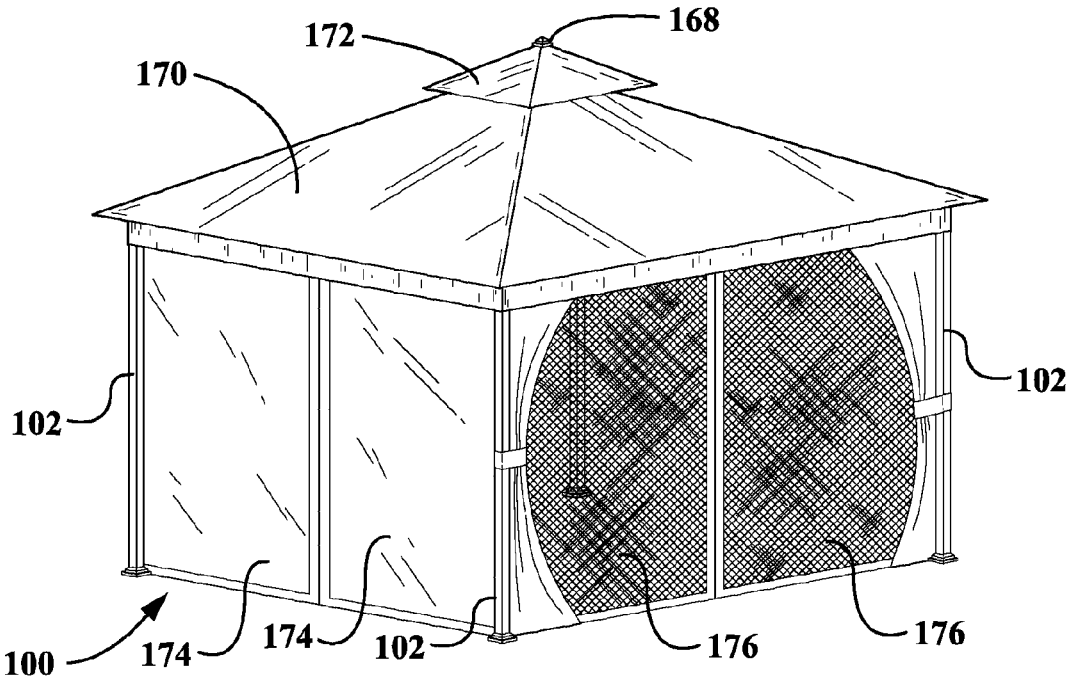
FIG. 1 is a perspective view of a portable shelter, according to a first embodiment of the invention, wherein the side panels and the roof canopy are shown disposed on the portable shelter.

A first exemplary embodiment of the portable shelter or gazebo is seen generally at 100 in FIGS. 1-18. Initially, referring primarily to the assembled perspective view of FIG. 4 and the exploded perspective view of FIG. 18, it can be seen that the portable shelter framing system of the portable shelter 100 generally comprises a plurality of vertical support members (e.g., corner support posts 102); a plurality of crossbeam members 112, 126, each of the crossbeam members 112, 126 configured to be connected between a pair of the plurality of vertical support members 102 without the use of tools; and a plurality of roof frame members 148, 150, 152, 160, each of the roof frame members 148, 150, 152, 160 configured to be coupled to one of the plurality of vertical support members 102 or one of the plurality of crossbeam members 112, 126 without the use of tools. Advantageously, the portable shelter or gazebo 100 is designed to be assembled without the use of any tools, such as screwdrivers, wrenches, etc. Not only does this substantially reduce the time which is required to assemble the portable shelter or gazebo 100, but it also permits the portable shelter or gazebo 100 to be installed by a user who does not have access to any tools.

Figure 8:
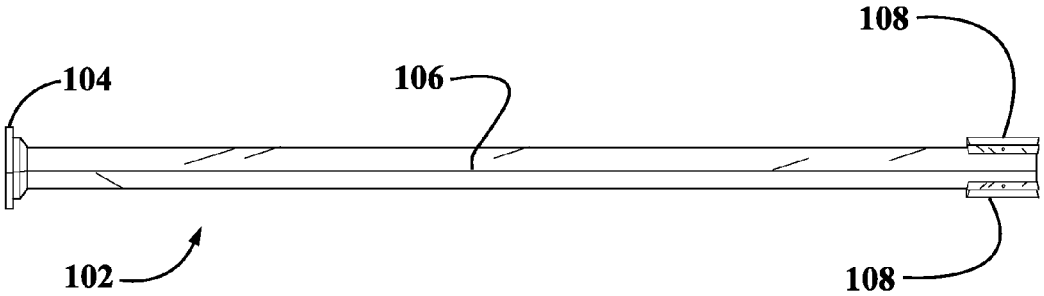
FIG. 8 is a side perspective view of one of the vertical support members of the portable shelter, according to the first embodiment of the invention, wherein the vertical support member is in the form of a corner post member.
Figure 17:
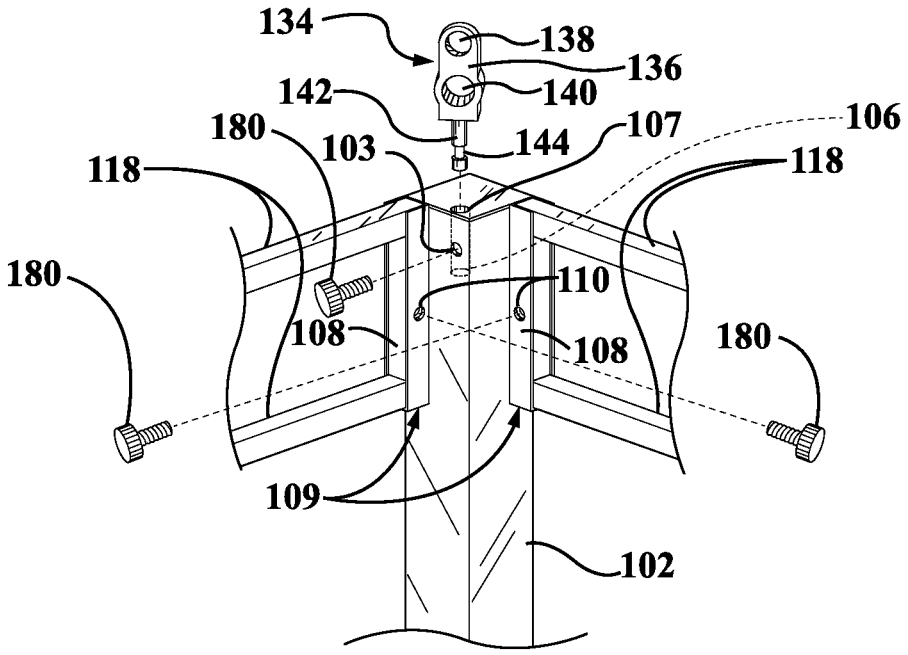
FIG. 17 is an enlarged perspective view of crossbeam members attached to one of the vertical support members of the portable shelter, according to the first embodiment of the invention, wherein one of the connecting members also is illustrated exploded therefrom.

As shown in FIGS. 1-4 and 18, the vertical support members of the portable shelter framing system of the first illustrated embodiment are in the form of corner post members 102. With reference to FIG. 8, it can be seen that each corner post member 102 includes a base portion 104, a tubular body portion 106, and a pair of C-shaped channel members 108 that are disposed proximate to the end of the tubular body portion 106 (e.g., the top end), which is opposite to the end having the base portion 104 (e.g., the bottom end). The pair of channel members 108 are oriented generally perpendicular to one another (i.e., on adjacent sides of the tubular body portion 106 of the corner post member 102). Each of the pair of channel members 108 is configured to receive an end portion 112*a*, 112*b*, 126*a*, 126*b* of one of the plurality of crossbeam members 112, 126 (see FIG. 18). As best shown in the connection detail of FIG. 17, each of the channel members 108 comprises a bottom base plate 109 that is secured to a side of the tubular body portion 106 of the corner post member 102 and two spaced-apart side plates that are attached to opposed sides of the bottom base plate 109. In FIG. 17, it can be seen that one of the side plates is provided with an aperture 110 disposed therethrough for receiving a fastener member 180.

Figure 10:
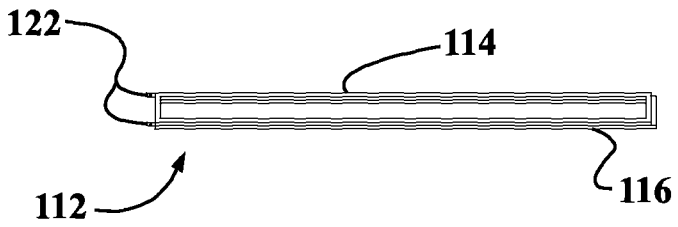
FIG. 10 is a side perspective view of one of the folding crossbeam members of the portable shelter, according to the first embodiment of the invention, wherein the folding crossbeam member is shown in a folded state.
Figure 16:
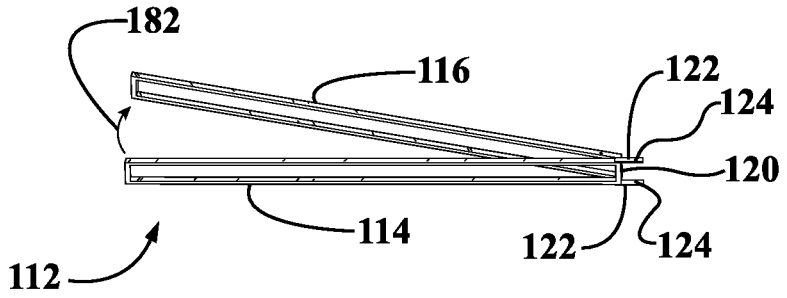
FIG. 16 is a side perspective view of one of the folding crossbeam members of the portable shelter, according to the first embodiment of the invention, wherein the folding crossbeam member is shown in a partially unfolded state.

Now, with reference to FIGS. 4, 10, 16, and 18, the crossbeam members 112, 126 will be described in detail. As best shown in the perspective view of FIG. 4, the portable shelter framing system of the portable shelter 100 includes a pair of first crossbeam members 112 with first and second sections 114, 116 and a pair of second crossbeam members 126 with first and second sections 128, 130. The first crossbeam members 112 are essentially the same as the second crossbeam members 126, except that the first crossbeam members 112 have a longer length than the second crossbeam members 126 (the portable shelter 100 has a generally rectangular shape with two longer sides and two shorter sides). Advantageously, in the illustrative embodiment, each of the crossbeam members 112, 126 is capable of being folded approximately in half so as to reduce the amount of space that each crossbeam member 112, 126 occupies when the portable shelter 100 is being stored and transported (in its disassembled state). The foldable nature of the crossbeam members 112, 126 is shown in FIGS. 10 and 16. With particular reference to FIG. 16, it can be seen that the second section 116 of the crossbeam member 112 can be rotated in a clockwise direction 182 relative to the first section 114 of the crossbeam member 112 until the crossbeam member 112 is unfolded, wherein the first and second sections 114, 116 are disposed in a generally linear arrangement. During the unfolding of the crossbeam member 112, the second section 116 rotates about a pivotal axis disposed through the hinge member 120 (see detailed view of FIG. 25). Once the second section 116 has been rotated approximately 180 degrees relative to the first section 114, and the crossbeam member 112 is completely unfolded, the second section 116 is locked in place relative to the first section 114 by the engagement of the opposed pins 125 on the second section 116 with the corresponding apertures 124 in the projecting members 122 of the first section 114. As shown in FIG. 16, the projecting members 122 extend from the end of the first section 114. Each of the first and second sections 114, 116 of the crossbeam members 112 is in the form of a rectangular-shaped tubular frame 118.

Figure 15:
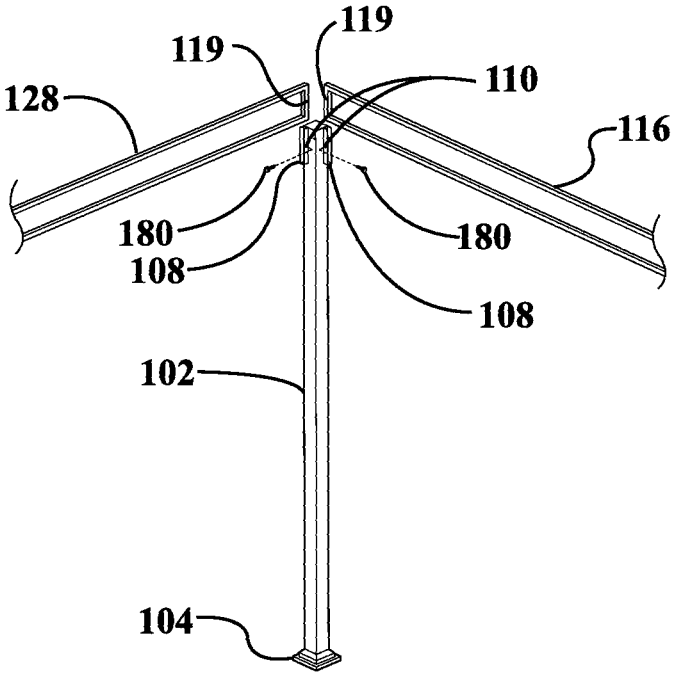
FIG. 15 is an exploded perspective view illustrating two partial crossbeam members exploded from a vertical support member of the portable shelter, according to the first embodiment of the invention.
Figure 18:
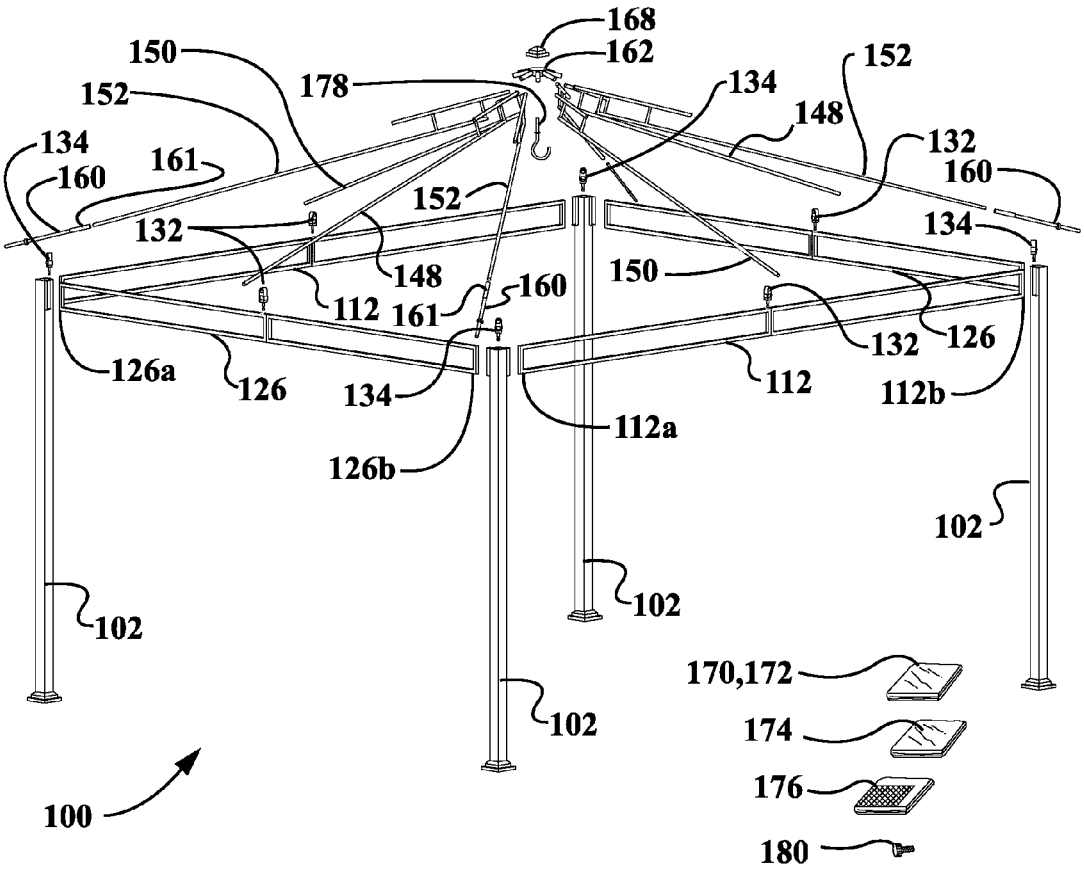
FIG. 18 is an overall exploded perspective view of the portable shelter framing system, according to the first embodiment of the invention, wherein the four post-type portable shelter is provided with framing for a roof vent.

Referring particularly to FIG. 18, it can be seen that each of the crossbeam members 112, 126 has opposed first and second end portions 112*a*, 112*b* and 126*a*, 126*b*. As best illustrated in FIG. 15, each of the crossbeam members 112, 126 further includes a first aperture 119 provided in a first end portion 112*a* or 126*a* and a second aperture 119 provided in a second end portion 112*b* or 126*b*. The apertures 110 in the sides of the channel members 108 are configured to substantially align with one of the first and second apertures 119 on a respective crossbeam member 112, 126 when the crossbeam member 112, 126 and the vertical support member 102 are engaged with one another (as shown in the detail of FIG. 17). Each of the first and second end portions 112*a*, 112*b*, 126*a*, 126*b* of each crossbeam member 112, 126 is secured to a respective C-shaped channel member 108 on the vertical support member 102 by means of a respective fastener 180 passing through a respective one of the first and second apertures 119 of the crossbeam member 112, 126 and a respective aperture 110 of the channel member 108.

Figure 4:
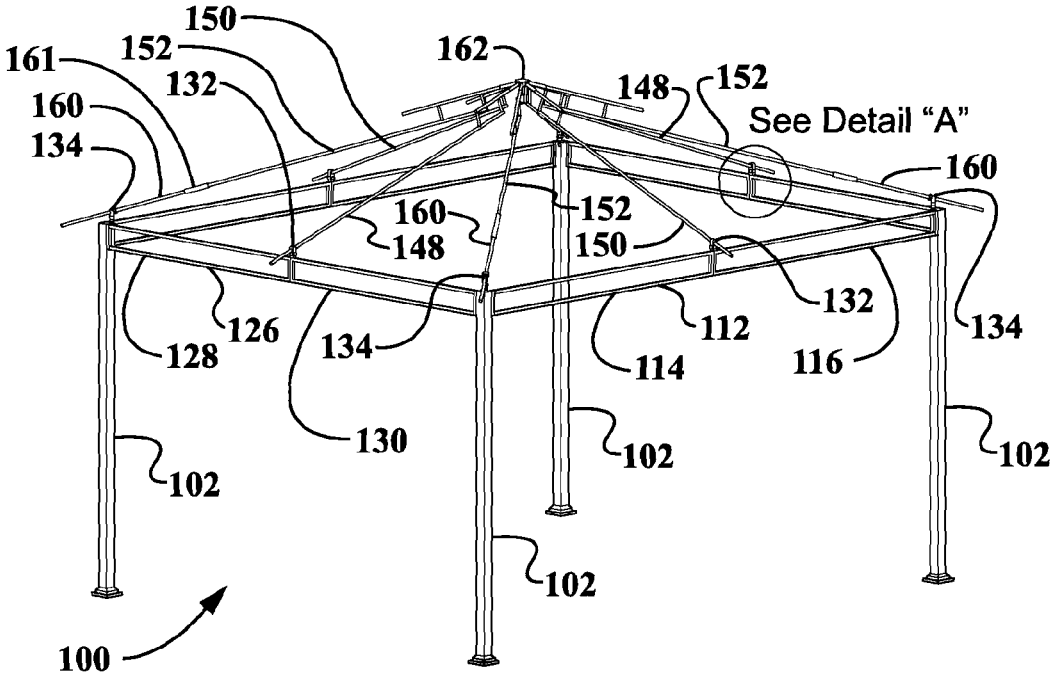
FIG. 4 is still another perspective view of the portable shelter, according to the first embodiment of the invention, wherein the side panels, the peripheral roof canopy portion, and the central roof canopy portion have all been removed from the portable shelter to better illustrate the framing system thereof.
Figure 5:
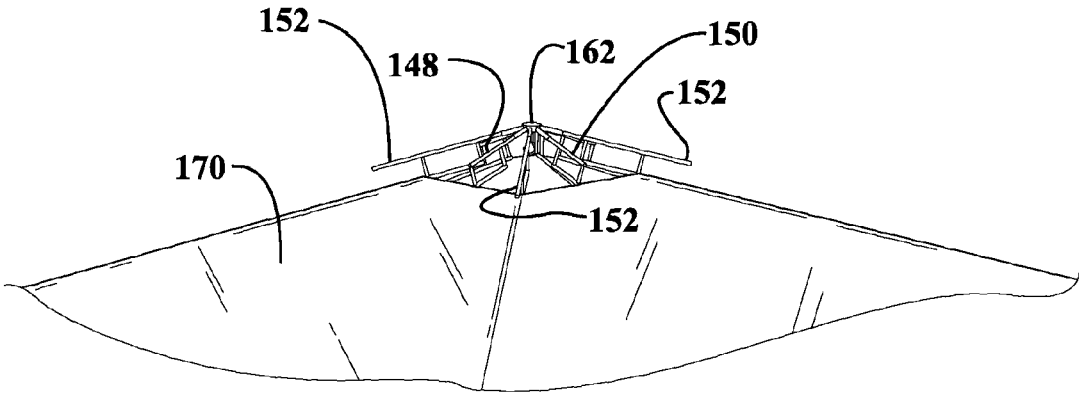
FIG. 5 is a partial perspective view of the central roof portion of the portable shelter, according to the first embodiment of the invention, wherein the central roof canopy portion has been removed to better illustrate the roof framing members.
Figure 11:
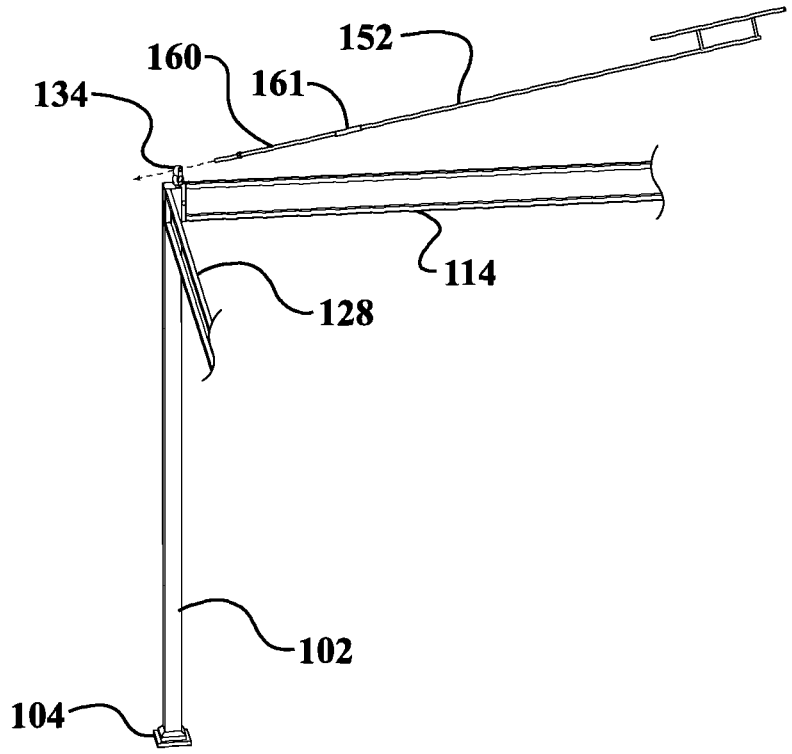
FIG. 11 is a perspective view of partial crossbeam members attached to one of the vertical support members of the portable shelter, according to the first embodiment of the invention, wherein one of the corner roof frame members also is illustrated exploded therefrom.
Figure 12:
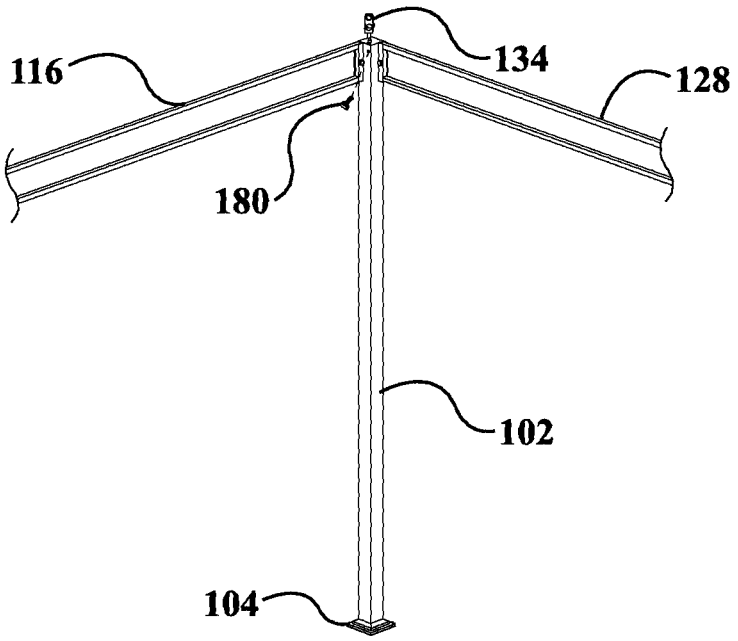
FIG. 12 is a perspective view of partial crossbeam members attached to one of the vertical support members of the portable shelter, according to the first embodiment of the invention, wherein one of the connecting members also is illustrated exploded therefrom.
Figure 13:
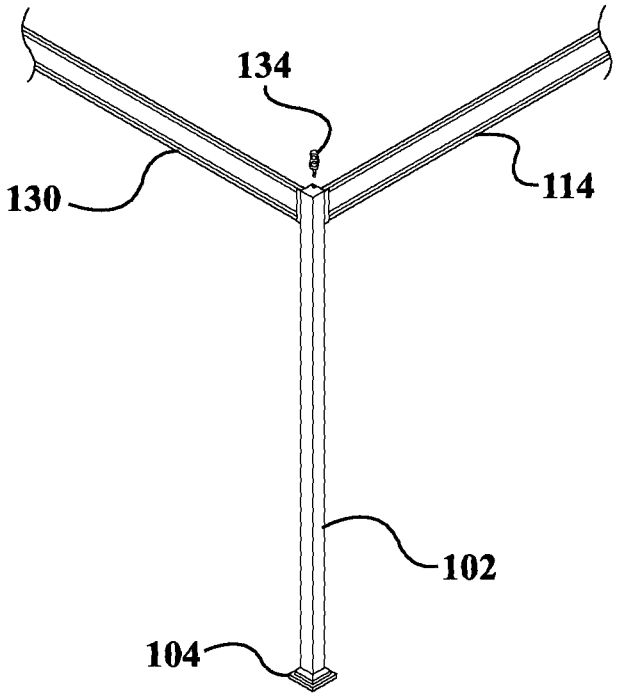
FIG. 13 is another perspective view of partial crossbeam members attached to one of the vertical support members of the portable shelter, according to the first embodiment of the invention, wherein one of the connecting members also is illustrated exploded therefrom.
Figure 14:
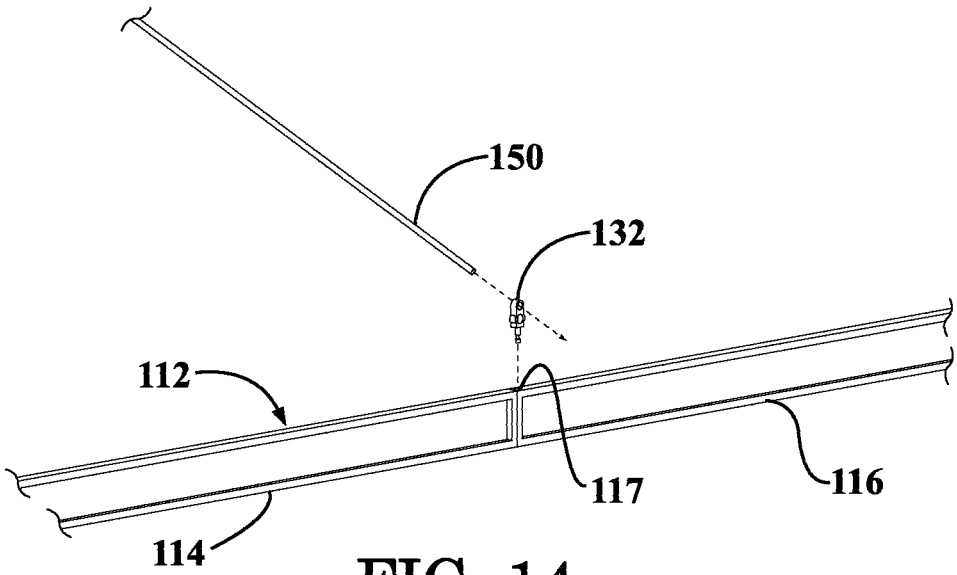
FIG. 14 is a perspective view of a partial unfolded crossbeam member illustrated with one of the connecting members of the portable shelter, according to the first embodiment of the invention, wherein one of the middle roof frame members also is illustrated exploded therefrom.
Figure 25:
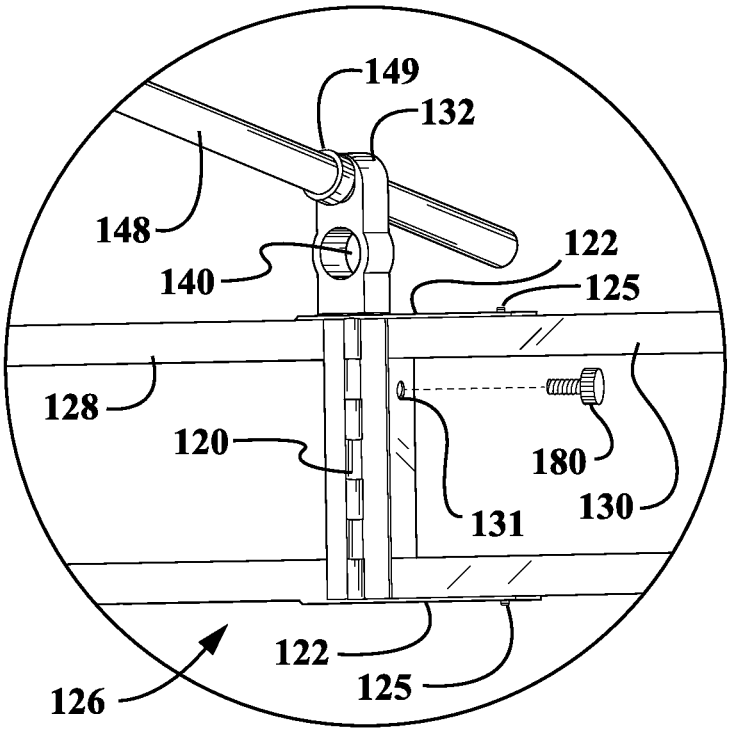
FIG. 25 is an enlarged, partial perspective view of the connection between one of the middle roof frame members and one of the crossbeam members in FIG. 4 (Detail "A"), according to the first and second embodiments of the invention.

Next, with reference to FIGS. 4, 17, and 18, the connecting members 132, 134 of the portable shelter framing system will be explained in detail. As shown in FIGS. 4 and 18, the connecting members 132 couple a respective one of the middle roof frame members 148, 150 to a respective one of the crossbeam members 126, 112 without the use of tools. Similarly, the connecting members 134 couple a respective one of the corner roof frame members 160 to a respective one of the vertical support members 102 without the use of tools. As best illustrated in the detailed view of FIG. 17, each connecting member 132, 134 includes a body portion 136 and a shaft portion 142 connected to the body portion 136. The body portion 136 of each connecting member 132, 134 has upper and lower apertures 138, 140 disposed therethrough. As shown in FIGS. 4, 14, and 25, the upper aperture 138 of the body portion 136 of each connecting member 132 receives a respective middle roof frame member 148, 150 therein. Similarly, as illustrated in FIGS. 4 and 11, the upper aperture 138 of the body portion 136 of each connecting member 134 receives a respective corner roof frame member 160 therein. Then, turning to FIG. 14, it can be seen that the shaft portion 142 of each connecting member 132 is designed to be inserted into a receiving aperture 117 in the top surface of a respective crossbeam member 112 (or the crossbeam member 126). In FIG. 17, it can be seen that the shaft portion 142 of each connecting member 134 is designed to be inserted into a receiving aperture 107 in the top surface of a respective vertical support member 102. In the illustrated embodiment, each vertical support member 102 is provided with a tubular sleeve 106 disposed therein that forms the receiving aperture 107 for the shaft portion 142 of each connecting member 134.

As shown in FIG. 17, the shaft portion 142 of each connecting member 134 (and each connecting member 132) is provided with a circumferential groove 144 disposed therein. Each of the connecting members 134 is securely coupled a respective one of the vertical support members 102 by means of the tool-less fastener 180 engaging the circumferential groove 144 of the shaft portion 142. That is, a user inserts the fastener 180 into the aperture 103 in the side of the vertical support member 102, and then, by using the knurled cap of the fastener 180, the user tightens the fastener 180 in the aperture 103 until the distal end portion (opposite the cap) of the fastener 180 engages the circumferential groove 144 in the shaft portion 142 of the connecting member 134. The engagement between the distal end portion of the fastener 180 and the circumferential groove 144 prevents the axial movement of the connecting member 134 relative to the vertical support member 102, thereby securing the connecting member 134 in place. Similarly, referring to FIG. 25, each of the connecting members 132 is securely coupled to a respective one of the crossbeam members 126 (or to one of the crossbeam members 112) by means of the fastener 180 engaging the circumferential groove 144 of the shaft portion 142. In particular, a user inserts the fastener 180 into the aperture 131 in the side of the tubular frame of folding crossbeam member 126, and then, by grasping the knurled cap of the fastener 180 with his or her fingers, the user tightens the fastener 180 in the aperture 131 until the distal end portion (opposite the cap) of the fastener 180 engages the circumferential groove 144 in the shaft portion 142 of the connecting member 132. Similar to that described above for the engagement between the connecting member 134 and the vertical support member 102, the engagement between the distal end portion of the fastener 180 and the circumferential groove 144 prevents the axial movement of the connecting member 132 relative to the crossbeam member 126 (or the crossbeam member 112), thereby securing the connecting member 132 in place.

Now, with initial reference to FIGS. 4 and 18, the roof frame members of the portable shelter framing system of the first illustrative embodiment will be described. In general, it can be seen that the roof frame members 148, 150, 152 are circumferentially spaced apart from one another so as to form a supporting structure for a roof material, such as a canvas covering material. An upper end of each the roof frame members 148, 150, 152 is designed to be inserted into a respective outwardly extending tubular member 166 of a central connecting member 162 (see FIGS. 6 and 7). The central connecting member 162 has a central body portion 164 with a plurality of peripheral tubular members 166 extending outwardly therefrom. As such, the central connecting member 162 generally resembles an octopus, wherein the central body portion 164 forms the body of the octopus and the peripheral tubular members 166 form the legs of the octopus. As shown in the assembled perspective view of FIG. 4, each of the roof frame members 148, 150, 152 engages with a respective one of the peripheral tubular members 166 of the central connecting member 162 so that a generally rigid roof structure is formed thereby.

Figure 6:
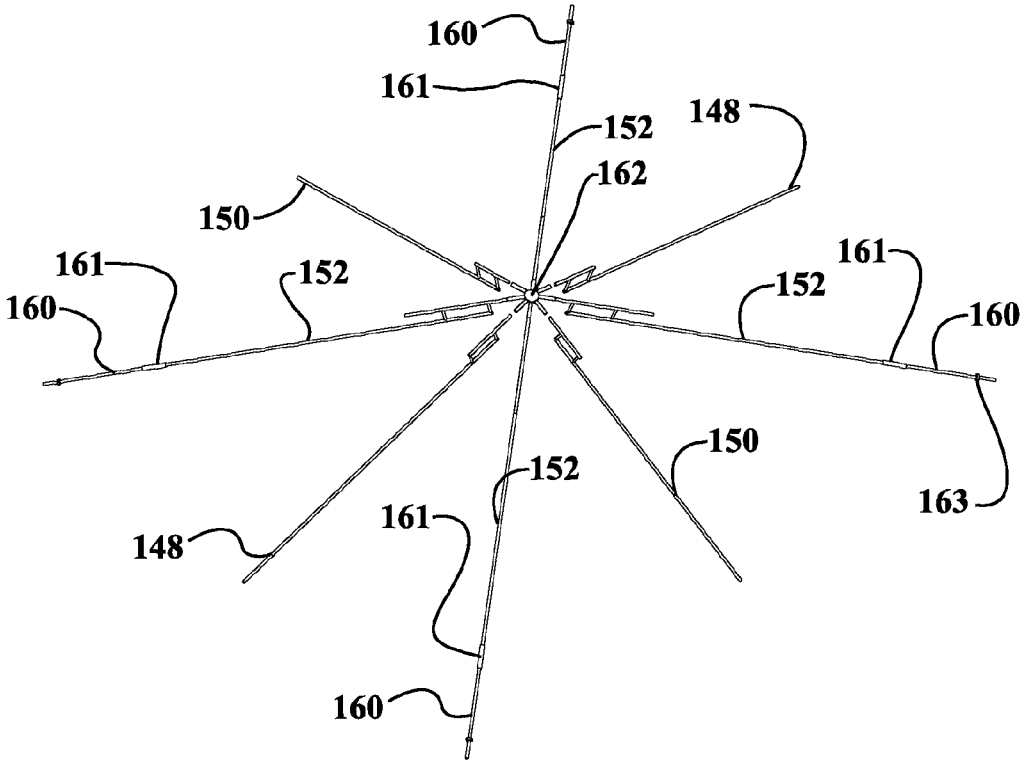
FIG. 6 is a partially exploded perspective view of the roof frame assembly of the portable shelter, according to the first embodiment of the invention.
Figure 7:
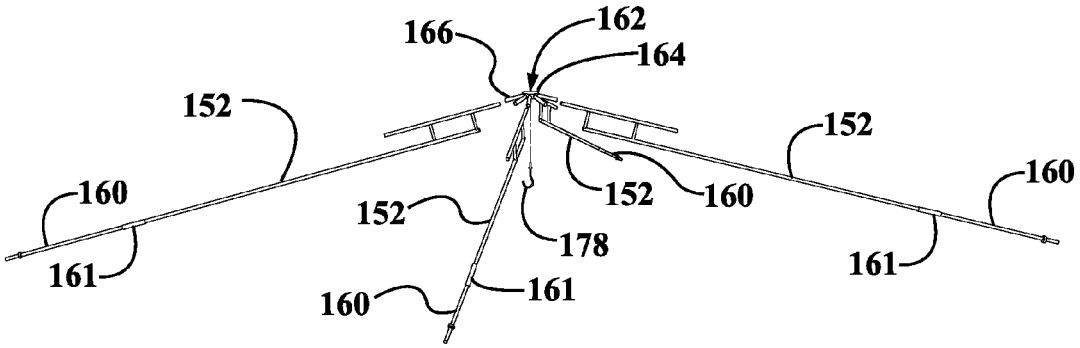
FIG. 7 is a partially exploded perspective view of the corner roof frame members and the central connecting member of the portable shelter, according to the first embodiment of the invention.

In the illustrated embodiment, the roof framing members include two (2) middle roof frame members 148 having a first length, two (2) middle roof frame members 150 having a second length, four (4) corner roof frame members 152, and four (4) corner roof frame extension members 160. As shown in FIG. 18, the first length of the middle roof frame members 148 is greater than the second length of the middle roof frame members 150. As best shown in FIGS. 6, 7, and 18, the corner roof frame extension members 160 are provided with belled end portions 161 so that they are capable of receiving a lower end portion of a respective corner roof frame member 152. That is, the corner roof frame extension members 160 attach to the ends of the corner roof frame members 152, thereby extending their overall length. Also, referring again to FIGS. 6, 7, and 18, it can be seen that each of the roof frame extension members 160 is provided with a collar portion 163 for preventing an axial movement of the roof frame extension member 160 when the roof frame extension member 160 is engaged with the aperture 138 in the body portion 136 of a respective connecting member 132, 134 (also refer to FIG. 25 for a detailed view of a collar portion 149 on a middle roof frame member 148). That is, the collar portion 149 can also be provided on each middle roof frame member 148, 150, 184, 186, 218, 220 to prevent the middle roof frame members 148, 150, 184, 186, 218, 220 from sliding downwardly in the aperture 138.

Figure 9:
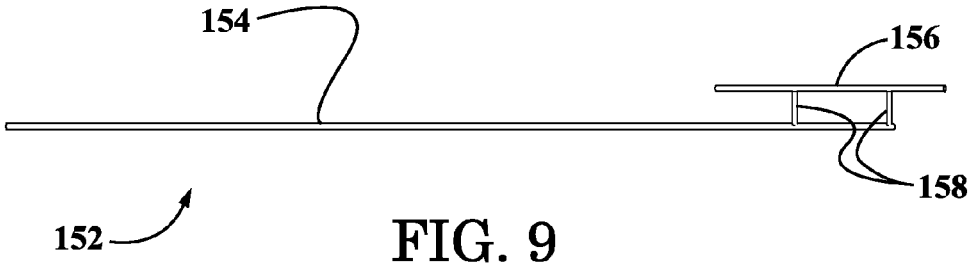
FIG. 9 is a side view of one of the corner roof frame members of the portable shelter, according to the first embodiment of the invention.

A detailed view of one of the corner roof frame members 152 is shown in FIG. 9. Referring to this figure, it can be seen that the corner roof frame member 152 includes a pair of generally parallel, spaced apart lower and upper tubular members 154, 156. The lower tubular member 152 is substantially longer than the upper tubular member 156, and it supports the primary roof of the portable shelter 100. The short upper tubular member 156 is used to support the roof vent cover in the roof of the portable shelter 100 (see FIGS. 3 and 4). The pair of tubular members 154, 156 are connected to one another by two spaced apart tubular members 158, which are each disposed generally perpendicular to each of the lower and upper tubular members 154, 156. The tubular members 158 form the gap that is required for the roof vent in the portable shelter 100.

Figure 2:
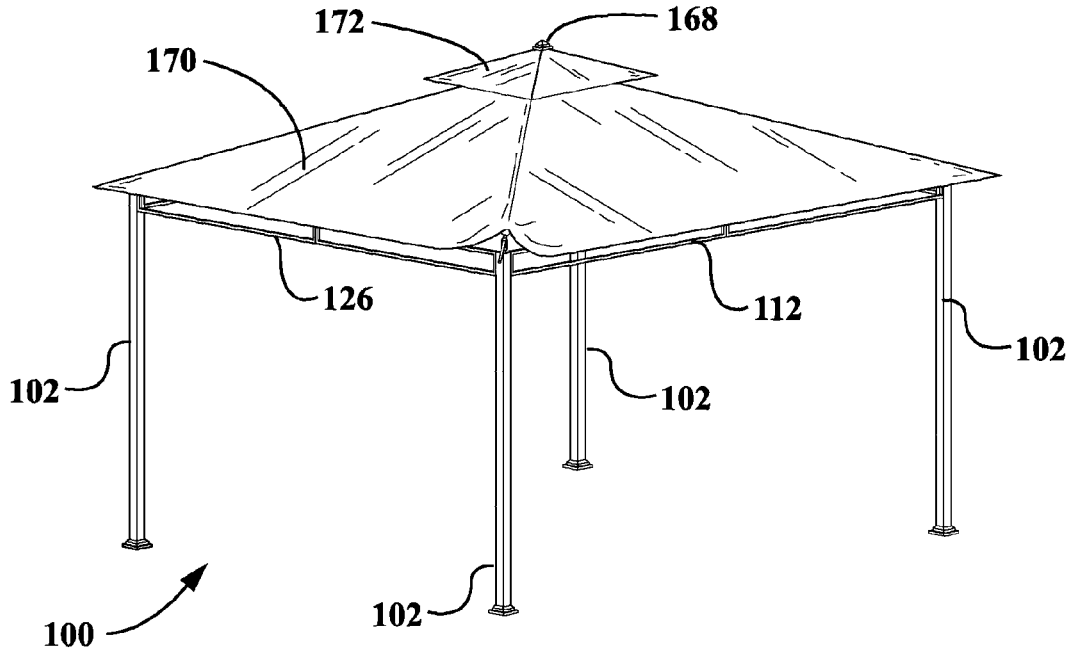
FIG. 2 is another perspective view of the portable shelter, according to the first embodiment of the invention, wherein the side panels have been removed from the portable shelter.
Figure 3:
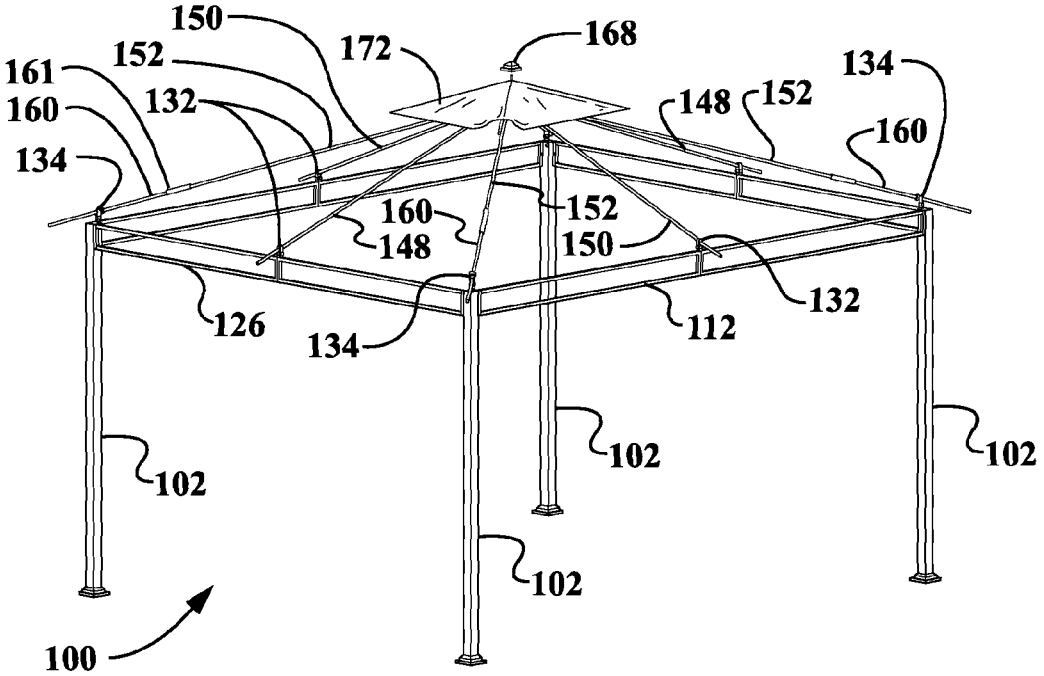
FIG. 3 is yet another perspective view of the portable shelter, according to the first embodiment of the invention, wherein both the side panels and the peripheral roof canopy portion have been removed from the portable shelter to better illustrate the framing system thereof.

Turning to FIGS. 1-3 and 18, the exterior coverings and other features of the portable shelter 100 will now be described. As best shown in FIGS. 1 and 2, a peripheral roof canopy portion 170 covers a majority of the roof framing system, while a central roof canopy portion 172 is disposed over the upper tubular members 156 of the corner roof frame members 152 that form the roof vent of the portable shelter 100. Together the peripheral roof canopy portion 170 and the central roof canopy portion 172 form the roof of the portable shelter 100. In FIGS. 1-3, it can be seen that a finial member 168 is provided at the central peak of the central roof canopy portion 172 to hold the canopy portion 172 in place. For example, the finial member 168 may be attached to the central connecting member 162 by a suitable fastener. In FIGS. 7 and 18, it can be seen that the underside of the central connecting member 162 is provided with a hook member 178 attached thereto (e.g., the end portion of the hook member 178 may be provided with a plurality of external threads that matingly engage with a plurality of internal threads on the central connecting member 162). As an example, the hook member 178 may be used for holding a hanging plant or a light inside the portable shelter 100.

In FIG. 1, it can be seen that one or more sides of the portable shelter 100 are provided with substantially solid side curtain panels 174, while one or more other sides of the portable shelter 100 are provided with netted side curtain panels 176. The netted side curtain panels 176 are designed to permit airflow therethrough, yet keep insects from entering the interior of the portable shelter 100. As shown in FIG. 1, the side curtain panels 174, 176 are supported from the support post members 102 and the crossbeam members 112, 126 of the portable shelter 100 by fastening straps or other suitable fastening members.

In one or more embodiments, the constituent components of the portable shelter framing system (e.g., as illustrated in FIGS. 4 and 18) are formed from a suitable metallic material, such as steel, while the roof canopy portions 170, 172 and the side curtain panels 174, 176 are formed from a suitable fabric, such as a polyester fabric material. However, those of ordinary skill in the art will appreciate that other suitable materials can be used for the various components of the portable shelter 100 as well.

Figure 19:
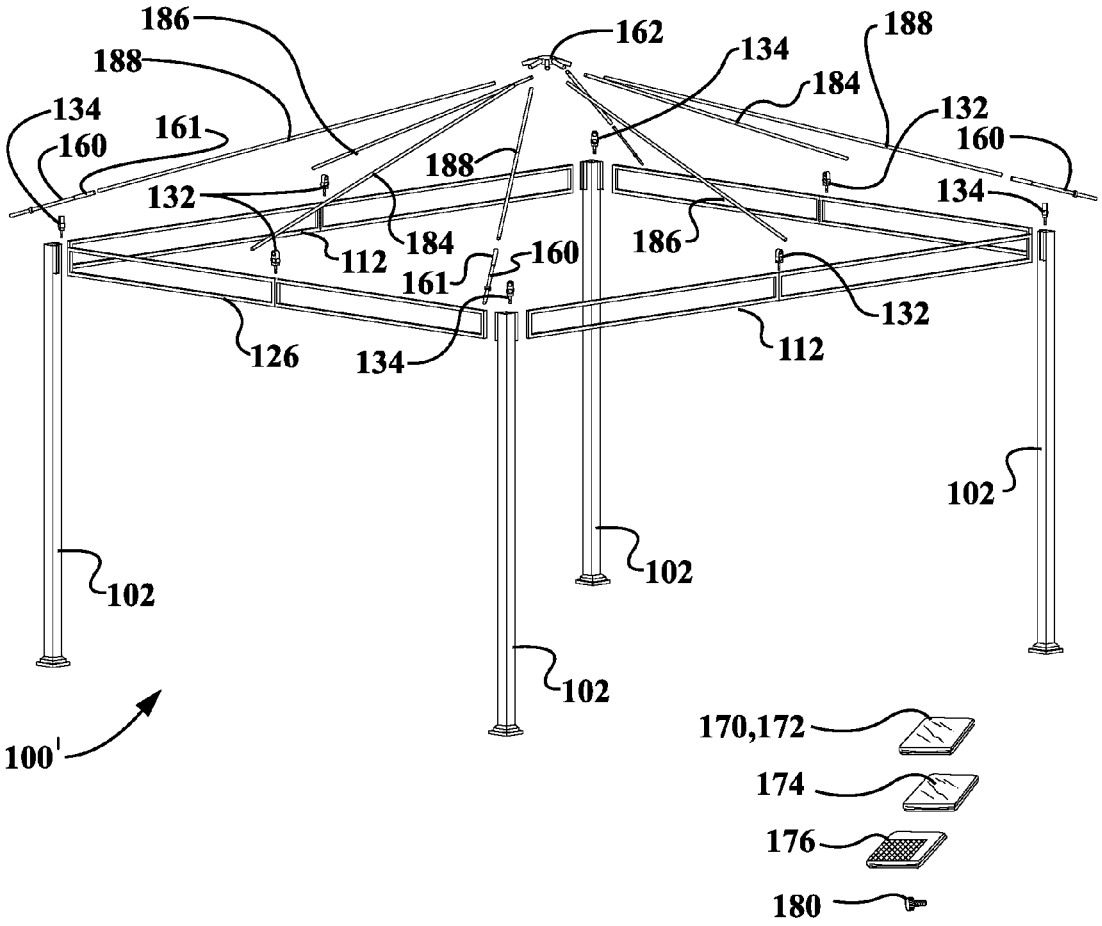
FIG. 19 is an overall exploded perspective view of a portable shelter framing system, according to a second embodiment of the invention, wherein the four post-type portable shelter is not provided with framing for a roof vent.

A second exemplary embodiment of the portable shelter or gazebo is seen generally at 100' in FIG. 19. Referring to this figure, it can be seen that, in many respects, the second exemplary embodiment is similar to that of the first embodiment. Moreover, many elements are common to both such embodiments. For the sake of brevity, the elements that the second embodiment of the portable shelter has in common with the first embodiment will not be discussed because these components have already been explained in detail above. Furthermore, in the interest of clarity, these elements are denoted using the same reference characters that were used in the first embodiment.

In the second exemplary embodiment, unlike the first exemplary embodiment, the roof of the portable shelter 100' is not provided with a roof vent. As such, the roof framing members of the portable shelter 100' are different from those described above for the first exemplary embodiment. In all other respects, portable shelter 100' is generally the same as the portable shelter 100.

The roof framing members of the portable shelter 100' will be described with reference to FIG. 19. In this figure, it can be seen that the portable shelter 100' has two (2) middle roof frame members 184 having a first length, two (2) middle roof frame members 186 having a second length, four (4) corner roof frame members 188, and four (4) corner roof frame extension members 160. As shown in FIG. 19, the first length of the middle roof frame members 184 is greater than the second length of the middle roof frame members 186. Unlike the roof frame members 148, 150, and 152 described above in conjunction with the first embodiment, the roof frame members 184, 186, and 188 do not contain the upper spaced-apart tubular members (e.g., members 156) that are used to create the roof vent gap in the portable shelter roof. Rather, as illustrated in FIG. 19, each of the roof frame members 184, 186, and 188 comprises a generally linear tubular member that is attached to the central connecting member 162.

Figure 20:
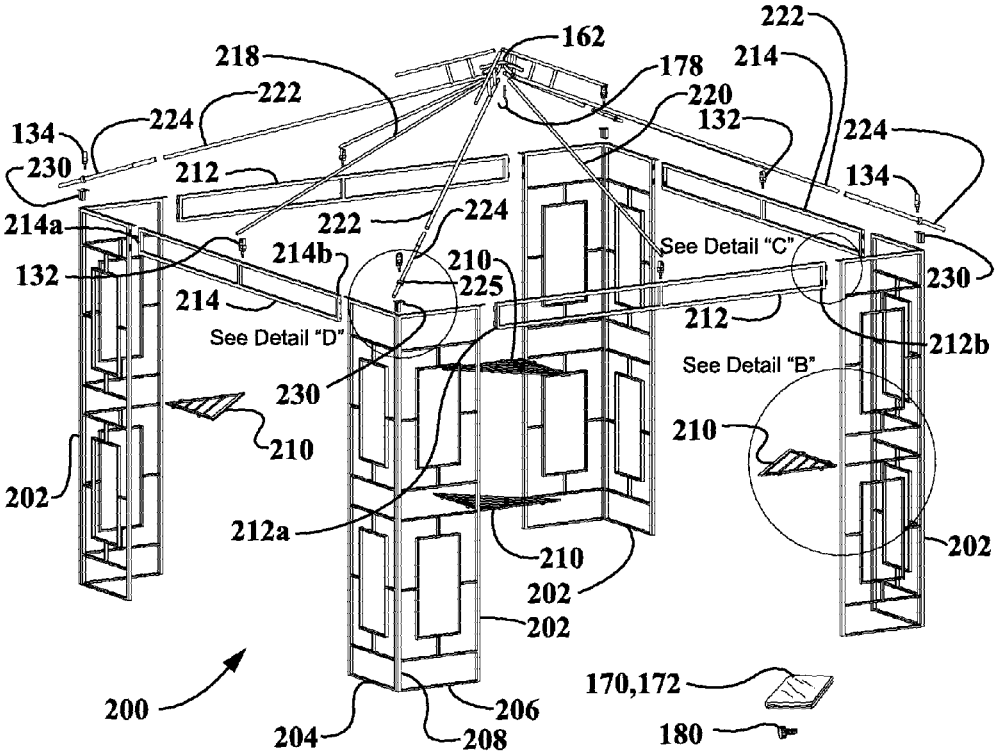
FIG. 20 is an overall exploded perspective view of a portable shelter framing system, according to a third embodiment of the invention, wherein a folding corner panel-type portable shelter is provided with framing for a roof vent.

A third exemplary embodiment of the portable shelter or gazebo is seen generally at 200 in FIG. 20, and details of the third embodiment are shown in FIGS. 26-29. Referring to these figures, it can be seen that, in some respects, the third exemplary embodiment is similar to that of the preceding two embodiments. Moreover, some elements are common to all of the embodiments. For the sake of brevity, the elements that the third embodiment of the portable shelter has in common with the first and second embodiments will not be discussed because these components have already been explained in detail above. Furthermore, in the interest of clarity, these elements are denoted using the same reference characters that were used in the first two embodiments.

In the third exemplary embodiment, unlike the first and second embodiments, the vertical support members are in the form of folding corner frame members 202, rather than corner post members 102. Also, in the third embodiment, the crossbeam members 212, 214 utilize different connection means for attaching to the vertical support members 202, as compared to that which was described above for the first embodiment. In addition, unlike the crossbeam members 112, 126 of the first and second embodiments, the crossbeam members 212, 214 do not fold approximately in half. Rather, the crossbeam members 212, 214 are generally in the form of non-folding, generally linear beams. In the third embodiment, the connecting members 134 are also attached to the vertical support members 202 in a different manner than that which was explained above for the first and second embodiments. Finally, the structures of the roof frame members 218-226 differ from those described in conjunction with the preceding two embodiments.

Figure 28A:
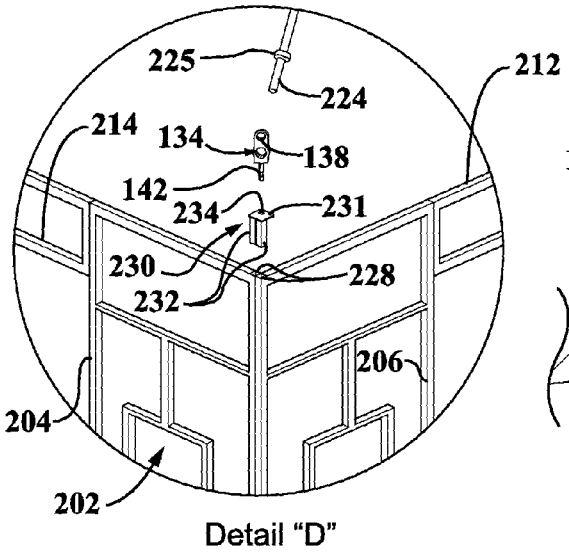
FIG. 28A is an enlarged, partial perspective view of the connection between one of the corner tubular roof frame members and one of the folding corner frame members in FIG. 20 (Detail "D"), according to the third and fourth embodiments of the invention.
Figure 28B:
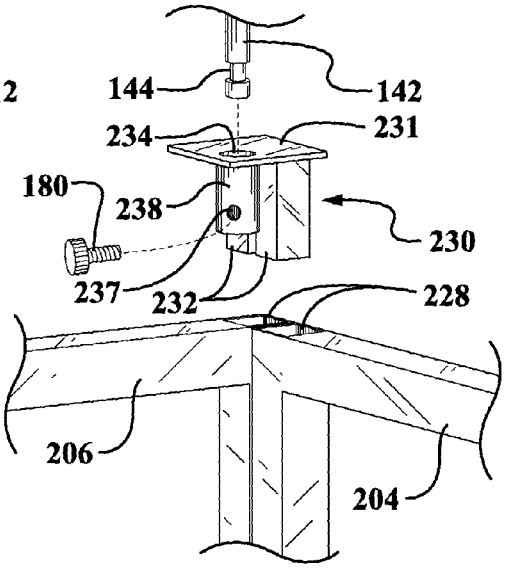
FIG. 28B is an enlarged, partial perspective view of the connection between one of the connecting members, one of the corner insert members, and one of the folding corner frame members in FIGS. 20 and 21, according to the third and fourth embodiments of the invention.
Figure 29:
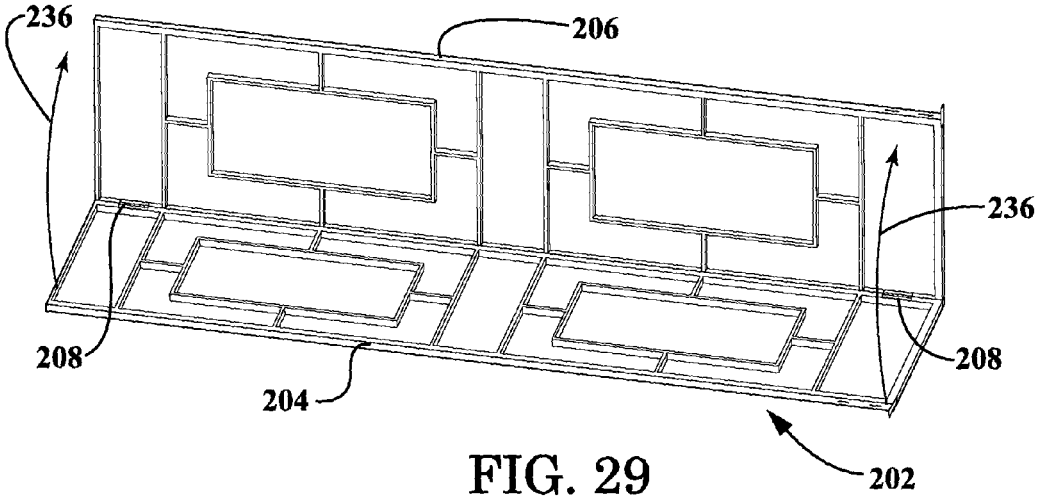
FIG. 29 is a side perspective view of one of the folding corner frame members of the portable shelter in FIGS. 20 and 21, according to the third and fourth embodiments of the invention, wherein the folding corner frame member is shown in an unfolded state.

Turning to FIGS. 20 and 29, it can be seen that the vertical support members of the portable shelter framing system of the third illustrated embodiment are in the form of folding corner frame members 202 (or folding corner panel members 202). With reference to these two figures, it can be seen that each folding corner frame member 202 includes a first panel section 204, a second panel section 206 pivotally coupled to the first panel section 204, and a plurality of hinge members 208 pivotally coupling the second panel section 206 to the first panel section 204. In FIG. 29, it can be seen that the second section 206 of the folding corner frame member 202 can be rotated in a clockwise direction 236 relative to the first section 204 of the folding corner frame member 202 until corner frame member 202 is completely unfolded, wherein the second section 206 is disposed generally perpendicular to the first section 204. During the unfolding of the corner frame member 202, the second section 206 rotates about a pivotal axis disposed through the hinge members 208 until the second section 206 has been rotated approximately 90 degrees relative to the first section 204, and the corner frame member 202 is completely unfolded. After the corner frame member 202 has been unfolded, the second section 206 can be locked in place relative to the first section 204 by inserting the corner insert member 230 into the insert apertures 228 of the corner frame member 202 (see FIGS. 28A and 28B).

Figure 26:
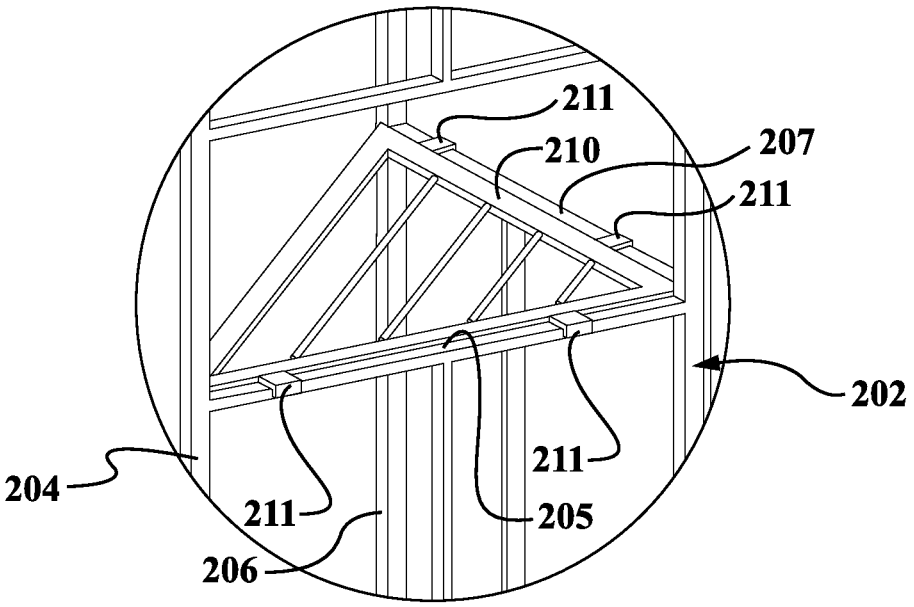
FIG. 26 is an enlarged, partial perspective view of the connection between one of the side panel shelf members and one of the folding corner frame members in FIG. 20 (Detail "B"), according to the third and fourth embodiments of the invention.

As shown in FIGS. 20 and 26, each of the corner frame members 202 is designed to accommodate a triangular-shaped shelf member 210. In the typical connection detail of FIG. 26, it can be seen that each of the shelf members 210 is provided with a plurality L-shaped prongs 211 (e.g., two prongs on each of two adjacent sides) for coupling the shelf member 210 to its respective corner frame member 202. Specifically, as shown in FIG. 26, the first pair of L-shaped prongs 211 is designed to engage with the transverse bar 205 of the first section 204 of the corner frame member 202, while the second pair of L-shaped prongs 211 is designed to engage with the transverse bar 207 of the second section 206 of the corner frame member 202. As such, the engagement between the L-shaped prongs 211 of each shelf member 210 and the transverse bars 205, 207 of each corner frame member 202 locks the shelf members 210 in place relative to their respective corner frame members 202.

Figure 27:
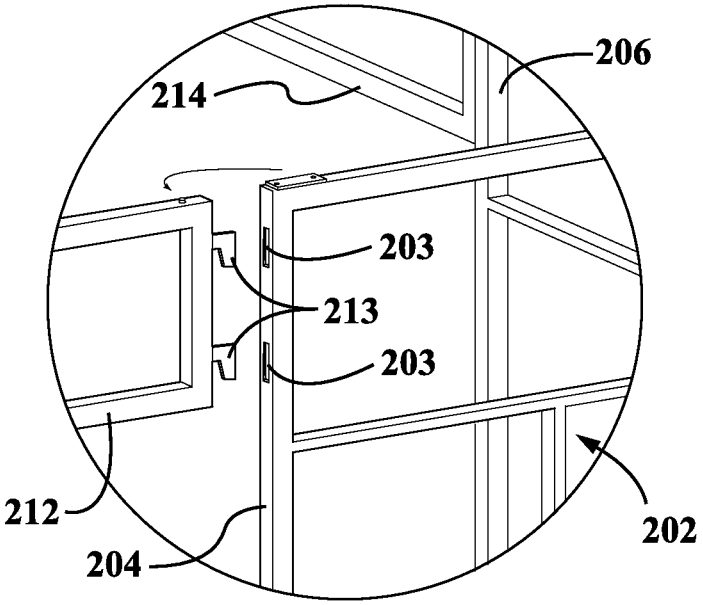
FIG. 27 is an enlarged, partial perspective view of the connection between one of the crossbeam members and one of the folding corner frame members in FIG. 20 (Detail "C"), according to the third and fourth embodiments of the invention.

Referring particularly to FIG. 20, it can be seen that each of the crossbeam members 212, 214 has opposed first and second end portions 212*a*, 212*b* and 214*a*, 214*b*. As best illustrated in FIG. 27, each of the crossbeam members 212, 214 further includes a first pair of hook members 213 extending from a first end portion 212*a* or 214*a* and a second pair of hook members 213 extending from a second end portion 212*b* or 214*b*. Also, as shown in FIGS. 20 and 27, the outer side edges of the first and second sections 204, 206 of each corner frame member 202 are provided with a pair of elongate slots 203 disposed near the top thereof. Each hook member 213 on the crossbeam members 212, 214 engages with a respective slot 203 in a corner frame member 202 (i.e., each hook member 213 is inserted into a respective slot 203) so as to attach the crossbeam members 212, 214 between the corner frame members 202.

Turning to FIGS. 28A and 28B, as briefly described above, a corner insert member 230 is provided at the interior corner of each corner frame member 202 in order to lock its sections 204, 206 in place relative to one another. As shown in the typical details of FIGS. 28A and 28B, each corner insert member 230 includes a top plate 231 with a plurality of tubular members 232 (i.e., two tubular members 232) extending from the bottom surface thereof. Each tubular member 232, which has a generally square-shaped cross-section, is configured to be received within a respective generally square-shaped aperture 228 in the top surface of the corner frame member 202. In addition to fixing the positions of the first and second sections 204, 206 of each corner frame member 202 relative to one another, each of the corner insert members 230 couples a respective one of the connecting members 134 to a respective one of the folding corner frame members 202 without the use of tools. In particular, as shown in FIGS. 28A and 28B, the shaft portion 142 of each connecting member 134 is designed to be inserted into a receiving aperture 234 in the top plate 231 of a respective corner insert member 230. As shown in FIG. 28B, each of the corner insert members 230 is provided with a tubular sleeve 238 disposed next to the tubular members 232 that forms the receiving aperture 234 for the shaft portion 142 of each connecting member 134.

As described above in conjunction with the first embodiment, the shaft portion 142 of each connecting member 134 is provided with a circumferential groove 144 disposed therein. Each of the connecting members 134 is securely coupled a respective one of the corner insert members 230 by means of a tool-less fastener 180 engaging the circumferential groove 144 of the shaft portion 142. That is, a user inserts the fastener 180 into an aperture 237 in the side of the tubular sleeve 238 of the corner insert member 230 (see FIG. 28B), and then, by using the knurled cap of the fastener 180, the user tightens the fastener 180 in the aperture until the distal end portion (opposite the cap) of the fastener 180 engages the circumferential groove 144 in the shaft portion 142 of the connecting member 134. The engagement between the distal end portion of the fastener 180 and the circumferential groove 144 prevents the axial movement of the connecting member 134 relative to the corner insert member 230, thereby securing the connecting member 134 in place.

Now, with reference to FIG. 20, the roof frame members of the portable shelter framing system of the third illustrative embodiment will be described. In general, similar to the first embodiment described above, it can be seen that the roof frame members 218, 220, 222 are circumferentially spaced apart from one another so as to form a supporting structure for a roof material, such as a canvas covering material. An upper end of each of the roof frame members 218, 220, 222 is designed to be inserted into a respective outwardly extending tubular member of the central connecting member 162.

In the third illustrated embodiment, the roof framing members include two (2) middle roof frame members 218 having a first length, two (2) middle roof frame members 220 having a second length, four (4) corner roof frame members 222, and four (4) corner roof frame extension members 224. As shown in FIG. 20, the first length of the middle roof frame members 218 is greater than the second length of the middle roof frame members 220. Like the roof frame extension members 160 described in conjunction with the first embodiment, the corner roof frame extension members 224 are provided with belled end portions so that they are capable of receiving a lower end portion of a respective corner roof frame member 222. That is, the corner roof frame extension members 224 attach to the ends of the corner roof frame members 222, thereby extending their overall length. Also, referring again to FIGS. 20 and 28A, it can be seen that each of the corner roof frame extension members 224 is provided with a collar portion 225 for preventing an axial movement of the roof frame extension member 224 when the roof frame extension member 224 is engaged with the aperture 138 in the body portion 136 of a respective connecting member 132, 134 (see e.g., FIG. 28A for a detailed view of the collar portion 225 on a corner roof frame extension member 224). That is, the collar portion 225 on each roof frame extension member 224 prevents the roof frame extension member 224 from sliding downwardly in the aperture 138. Referring to FIG. 20, it can be seen that the roof frame members 218, 220, 222 are generally similar to the roof frame members 148, 150, 152, except that the middle roof frame members 218, 220 are not provided with upper tubular members for supporting the roof vent covering material 172. Rather, only the four (4) corner roof frame members 222 are provided with upper tubular members for supporting the roof vent covering material 172 (see FIG. 20).

Figure 21:
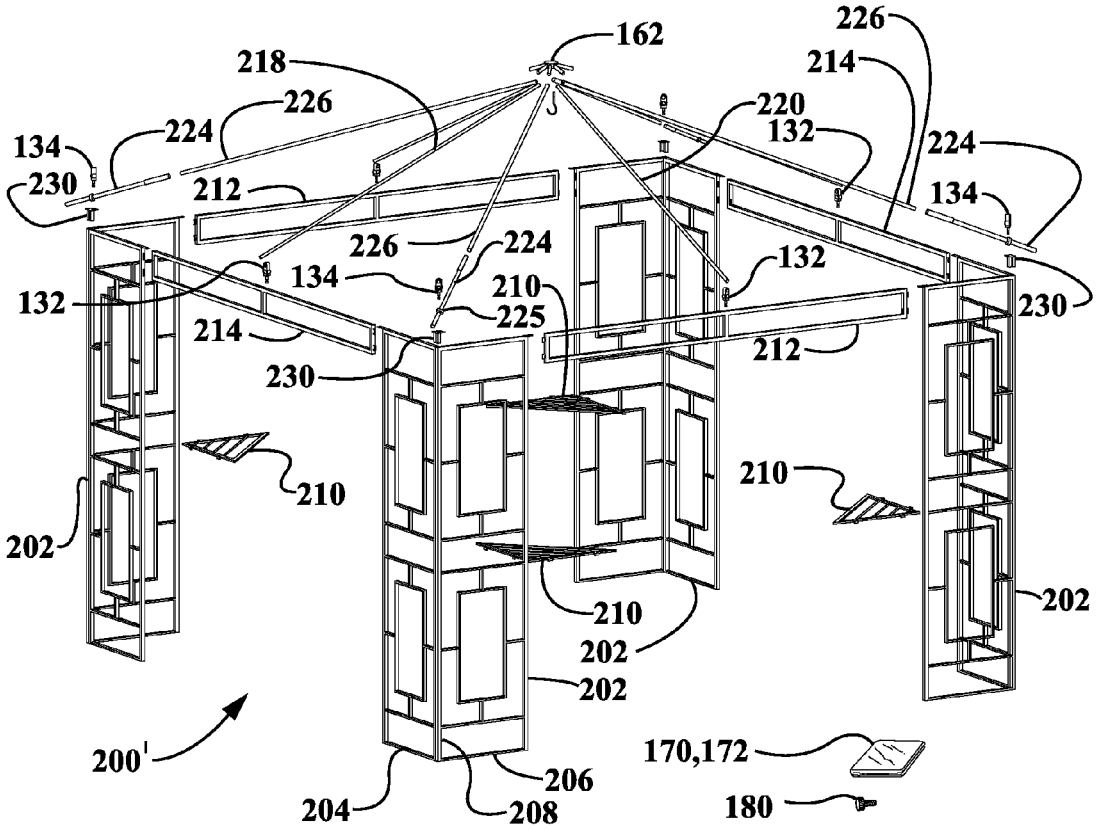
FIG. 21 is an overall exploded perspective view of a portable shelter framing system, according to a fourth embodiment of the invention, wherein the folding corner panel-type portable shelter is not provided with framing for a roof vent.
Figure 50:
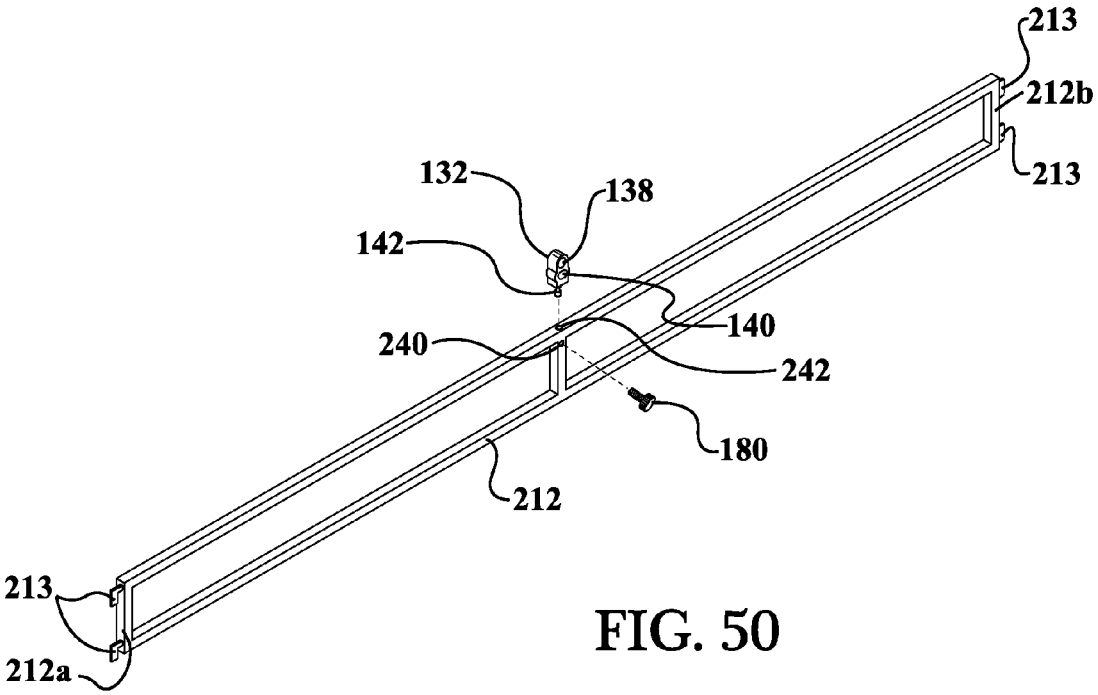
FIG. 50 is a side perspective view of the connection between one of the middle connecting members and one of the crossbeam members in FIG. 20, according to the third embodiment of the invention.
Figure 51:
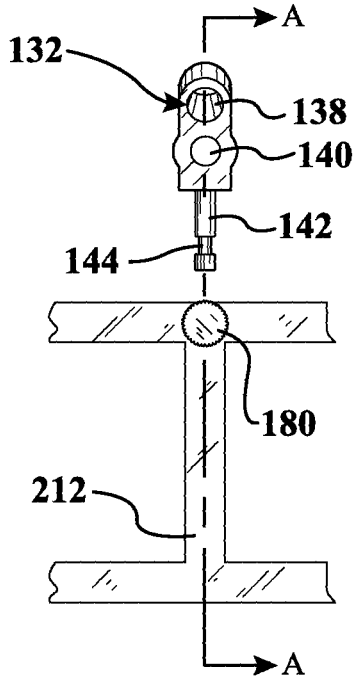
FIG. 51 is an enlarged side view of the connection between one of the middle connecting members and one of the crossbeam members in FIG. 20, according to the third embodiment of the invention.
Figure 52:
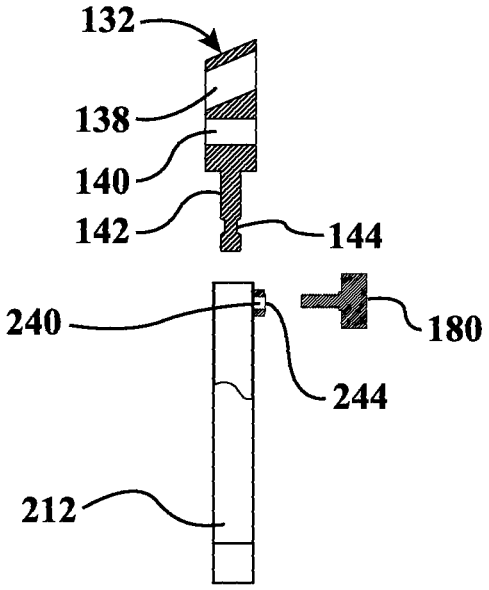
FIG. 52 is a transverse sectional view of the middle connecting member and the crossbeam member of FIG. 51, according to the third embodiment of the invention, wherein the section is generally cut along the cutting-plane line A-A in FIG. 51.

As shown in FIG. 21, each middle roof frame member 220 is coupled to one of the crossbeam members 212 by a respective connecting member 132. Referring now to the detail view of FIG. 50, it can be seen that the shaft portion 142 of each connecting member 132 is received within an aperture 242 disposed in the top surface of the crossbeam member 212. Then, with combined reference to FIGS. 50-52, it can be seen that each connecting member 132 is securely coupled a respective one of the crossbeam members 212 by means of the tool-less fastener 180 engaging the circumferential groove 144 of the shaft portion 142. That is, a user inserts the fastener 180 into the aperture 240 in the side of the crossbeam member 212, and then, by using the knurled cap of the fastener 180, the user tightens the externally-threaded fastener 180 in the internally-threaded boss 244 of the aperture 240 until the distal end portion (opposite the cap) of the fastener 180 engages the circumferential groove 144 in the shaft portion 142 of the connecting member 132. The engagement between the distal end portion of the fastener 180 and the circumferential groove 144 prevents the axial movement of the connecting member 132 relative to the crossbeam member 212, thereby securing the connecting member 132 in place.

A fourth exemplary embodiment of the portable shelter or gazebo is seen generally at 200' in FIG. 21. Referring to this figure, it can be seen that, in many respects, the fourth exemplary embodiment is similar to that of the third embodiment. Moreover, many elements are common to both such embodiments. For the sake of brevity, the elements that the fourth embodiment of the portable shelter has in common with the third embodiment will not be discussed because these components have already been explained in detail above. Furthermore, in the interest of clarity, these elements are denoted using the same reference characters that were used in the third embodiment.

In the fourth exemplary embodiment, unlike the third exemplary embodiment, the roof of the portable shelter 200' is not provided with a roof vent. As such, some of the roof framing members of the portable shelter 200' are different from those described above for the third exemplary embodiment. In all other respects, the portable shelter 200' is generally the same as the portable shelter 200.

The roof framing members of the portable shelter 200' will be described with reference to FIG. 21. In this figure, it can be seen that the portable shelter 200' has two (2) middle roof frame members 218 having a first length, two (2) middle roof frame members 220 having a second length, four (4) corner roof frame members 226, and four (4) corner roof frame extension members 224. As shown in FIG. 21, like the third embodiment, the first length of the middle roof frame members 218 is greater than the second length of the middle roof frame members 220. Although, unlike the roof frame members 222 described above in conjunction with the third embodiment, the roof frame members 226 do not contain the upper spaced-apart tubular members that are used to create the roof vent gap in the portable shelter roof. Rather, as illustrated in FIG. 21, each of the roof frame members 218, 220, and 226 comprises a generally linear tubular member that is attached to the central connecting member 162.

Figure 22:
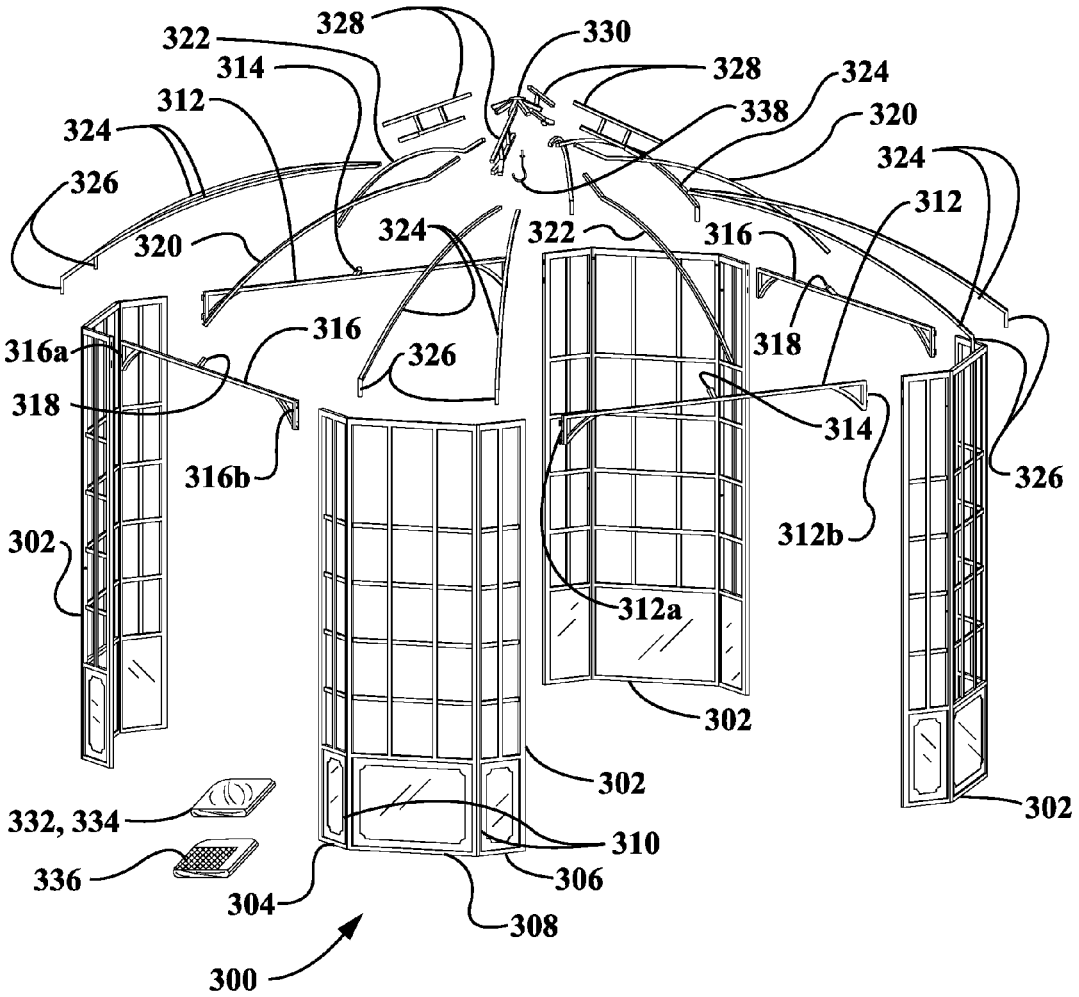
FIG. 22 is an overall exploded perspective view of a portable shelter framing system, according to a fifth embodiment of the invention, wherein a bay window-type portable shelter is provided with framing for a roof vent.

A fifth exemplary embodiment of the portable shelter or gazebo is seen generally at 300 in FIG. 22. Referring to this figure, it can be seen that, in some respects, the fifth exemplary embodiment is similar to that of the preceding four embodiments. In addition, some elements are similar to the previously described embodiments. For the sake of brevity, the elements that the fifth embodiment of the portable shelter has in common with the preceding four embodiments will not be discussed because these components have already been explained in detail above.

In the fifth exemplary embodiment, unlike the previously described embodiments, the vertical support members are in the form of folding bay window corner assemblies 302, rather than corner post members 102 or folding corner frame members 202. Also, in the fifth embodiment, the crossbeam members 312, 316 have a different structure than that which was described above for the preceding embodiments. In the fifth embodiment, the roof frame members 320, 322, 324 connect to the vertical support members 302 and the crossbeam members 312, 316 in a different manner than that which was explained above for the first four embodiments. Finally, the structures of the roof frame members 320-324 differ from those described in conjunction with the preceding four embodiments.

In FIG. 22, it can be seen that the vertical support members of the portable shelter framing system of the fifth illustrated embodiment are in the form of folding bay window corner assemblies 302 (or folding corner frame members 302). With reference to this figure, it can be seen that each folding bay window corner assembly 302 includes a center section 308, a first folding section 304 pivotally coupled to the center section 308, a second folding section 306 pivotally coupled to the center section 308, one or more first hinge members 310 pivotally coupling the first folding section 304 to the center section 308, and one or more second hinge members 310 pivotally coupling the second folding section 306 to the center section 308. The first folding section 304 of the folding bay window corner assembly 302 can be rotated in a counterclockwise direction relative to the center section 308 of the folding bay window corner assembly 302 until the first folding section 304 is completely unfolded. Similarly, the second folding section 306 of the folding bay window corner assembly 302 can be rotated in a clockwise direction relative to the center section 308 of the folding bay window corner assembly 302 until the second folding section 306 is completely unfolded. During the unfolding of the folding bay window corner assembly 302, the first and second folding sections 304, 306 each rotate about a respective pivotal axis disposed through the hinge members 210 until the first and second folding sections 304, 306 have been rotated approximately 135 degrees relative to the center section 308, and the folding bay window corner assembly 302 is completely unfolded.

Referring again to FIG. 22, it can be seen that each of the crossbeam members 312, 316 has opposed first and second end portions 312*a*, 312*b* and 316*a*, 316*b*. As shown in FIG. 22, similar to the third and fourth embodiments, each of the crossbeam members 312, 316 further includes a first pair of hook members extending from a first end portion 312*a* or 316*a* and a second pair of hook members extending from a second end portion 312*b* or 316*b*. Also, like the third and fourth embodiments, the outer side edges of the first and second folding sections 304, 306 of each folding bay window corner assembly 302 are provided with a pair of elongate slots disposed near the top thereof. Each hook member on the crossbeam members 312, 316 engages with a respective slot in a folding bay window corner assembly 302 (i.e., each hook member is inserted into a respective slot) so as to attach the crossbeam members 312, 316 between the folding bay window corner assemblies 302. As shown in FIG. 22, the structure of the crossbeam members 312, 316 is different from the crossbeam members described in conjunction with the preceding embodiments. In particular, each crossbeam member 312, 316 is provided with a center tubular portion bounded by triangular-shaped end portions with the hook members disposed thereon. Also, each of the crossbeam members 312 is provided with a centrally located, diagonally extending roof member connector 314, while each of the crossbeam members 316 is provided with a centrally located, diagonally extending roof member connector 318.

Now, with reference again to FIG. 22, the roof frame members of the portable shelter framing system of the fifth illustrative embodiment will be described. In general, similar to the embodiments described above, it can be seen that the roof frame members 320, 322, 324 are circumferentially spaced apart from one another so as to form a supporting structure for a roof material, such as a canvas covering material. An upper end of each the roof frame members 320, 322, 324 is designed to be coupled to an outwardly extending tubular member of a central connecting member 330, either directly or indirectly by means of a slanting arched beam connecting member 328. As shown in FIG. 22, each connecting member 328 has branched tubular portions, which are designed to engage with upper end portions of respective corner roof arched beam members 324 (i.e., the upper end portion of each corner beam member 324 is inserted into a respective branched tubular portion of a connecting member 328. The upper tubular member of each connecting member 328, which is spaced apart from the lower tubular member thereof by two (2) generally vertical tubular members, supports the roof vent cover 334 of the portable shelter 300.

In the fifth illustrated embodiment, the roof framing members include two (2) middle roof frame members 320 having a first length, two (2) middle roof frame members 322 having a second length, eight (8) corner roof frame members 324, and four (4) slanting arched beam connecting members 328 for connecting respective pairs of corner roof frame members 324 together. As shown in FIG. 22, the first length of the middle roof frame members 320 is greater than the second length of the middle roof frame members 322. Each of the corner roof frame members 324 is provided with downturned lower end portions 326 that are configured to be received within respective apertures in the top of each folding bay window corner assembly 302 (i.e., each downturned end portion 326 is inserted into an aperture near an outer side edge of the center section 308 of the folding bay window corner assembly 302, proximate to the locations where the first and second folding sections 304, 306 are hingedly connected to the center section 308). The lower end portions of the middle roof frame members 320 engage with the diagonally extending roof member connectors 318 (i.e., the lower end portions of the middle roof frame members 320 are inserted into diagonally extending roof member connectors 318), while the lower end portions of the middle roof frame members 322 engage with the diagonally extending roof member connectors 314 (i.e., the lower end portions of the middle roof frame members 322 are inserted into diagonally extending roof member connectors 314).

Turning again to FIG. 22, the exterior coverings and other features of the portable shelter 300 will now be described. Similar to that described above in conjunction with the first embodiment, a peripheral roof canopy portion 332 is configured to cover a majority of the roof framing system, while a central roof canopy portion 334 is configured to be disposed over the upper tubular members of the connecting members 328 that form the roof vent of the portable shelter 300. Together the peripheral roof canopy portion 332 and the central roof canopy portion 334 form the roof of the portable shelter 300. In FIG. 22, it can be seen that the underside of the central connecting member 330 is provided with a hook member 338 attached thereto (e.g., the end portion of the hook member 338 may be provided with a plurality of external threads that matingly engage with a plurality of internal threads on the central connecting member 330). The hook member 338 may be used for the same purposes described above for the first embodiment. The sides of the portable shelter 300 are configured to be covered with netted side curtain panels 336 that are designed to permit airflow therethrough, yet keep insects from entering the interior of the portable shelter 300.

Figure 23:
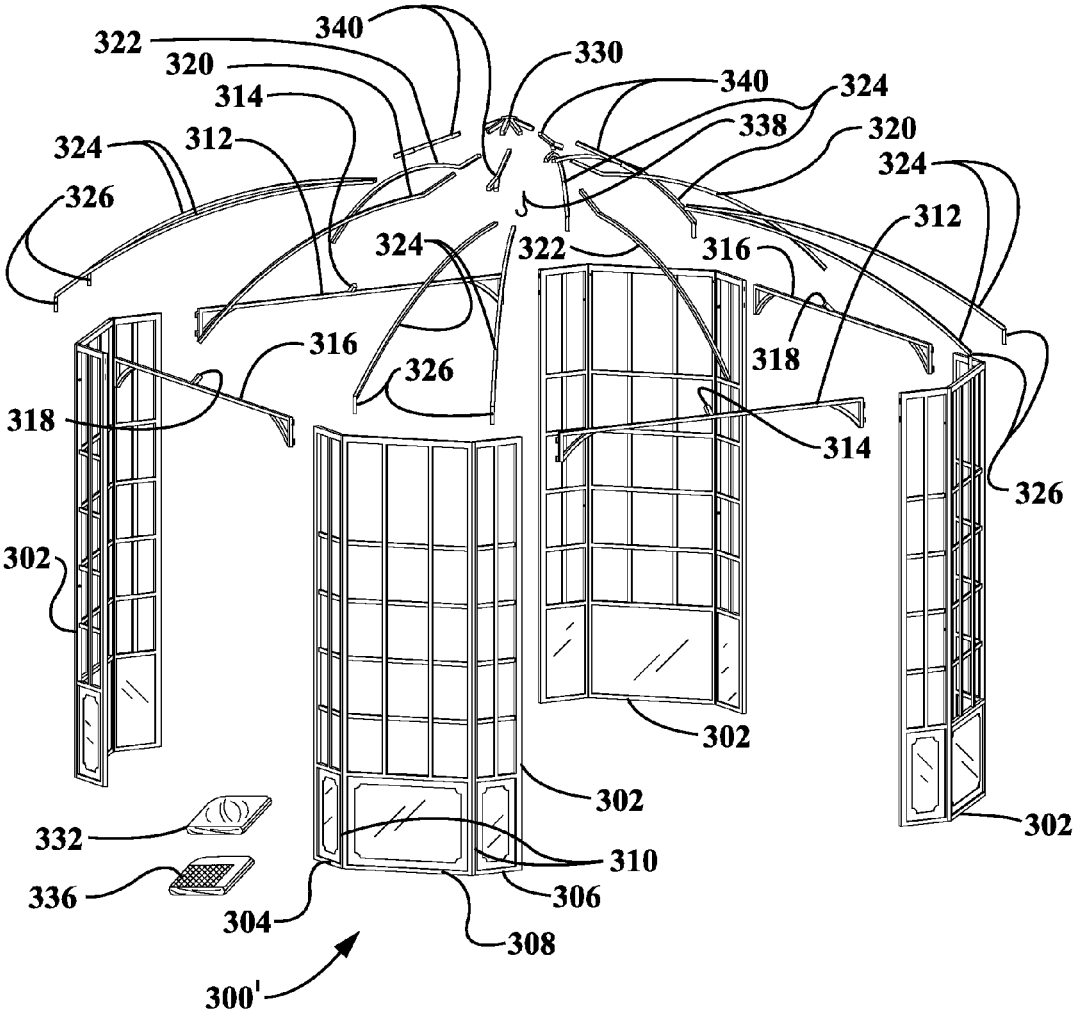
FIG. 23 is an overall exploded perspective view of a portable shelter framing system, according to a sixth embodiment of the invention, wherein the bay window-type portable shelter is not provided with framing for a roof vent.

A sixth exemplary embodiment of the portable shelter or gazebo is seen generally at 300' in FIG. 23. Referring to this figure, it can be seen that, in many respects, the sixth exemplary embodiment is similar to that of the fifth embodiment. Moreover, many elements are common to both such embodiments. For the sake of brevity, the elements that the sixth embodiment of the portable shelter has in common with the fifth embodiment will not be discussed because these components have already been explained in detail above. Furthermore, in the interest of clarity, these elements are denoted using the same reference characters that were used in the fifth embodiment.

In the sixth exemplary embodiment, unlike the fifth exemplary embodiment, the roof of the portable shelter 300' is not provided with a roof vent. As such, some of the roof framing members of the portable shelter 300' are different from those described above for the fifth exemplary embodiment. In all other respects, portable shelter 300' is generally the same as the portable shelter 300.

The roof framing members of the portable shelter 300' will be described with reference to FIG. 23. In this figure, it can be seen that the portable shelter 300' has two (2) middle roof frame members 320 having a first length, two (2) middle roof frame members 322 having a second length, eight (8) corner roof frame members 324, and four (4) slanting arched beam connecting members 340 for connecting respective pairs of corner roof frame members 324 together. As shown in FIG. 23, the first length of the middle roof frame members 320 is greater than the second length of the middle roof frame members 322. Although, unlike the slanting arched beam connecting members 328 described above in conjunction with the fifth embodiment, the slanting arched beam connecting members 340 do not contain the upper spaced-apart tubular members that are used to create the roof vent gap in the portable shelter roof. Rather, as illustrated in FIG. 23, each of the slanting arched beam connecting members 340 merely comprises a generally Y-shaped connecting member that is designed to couple the upper ends of a pair of corner roof frame members 324 to an outwardly extending tubular member of a central connecting member 330.

Figure 24:
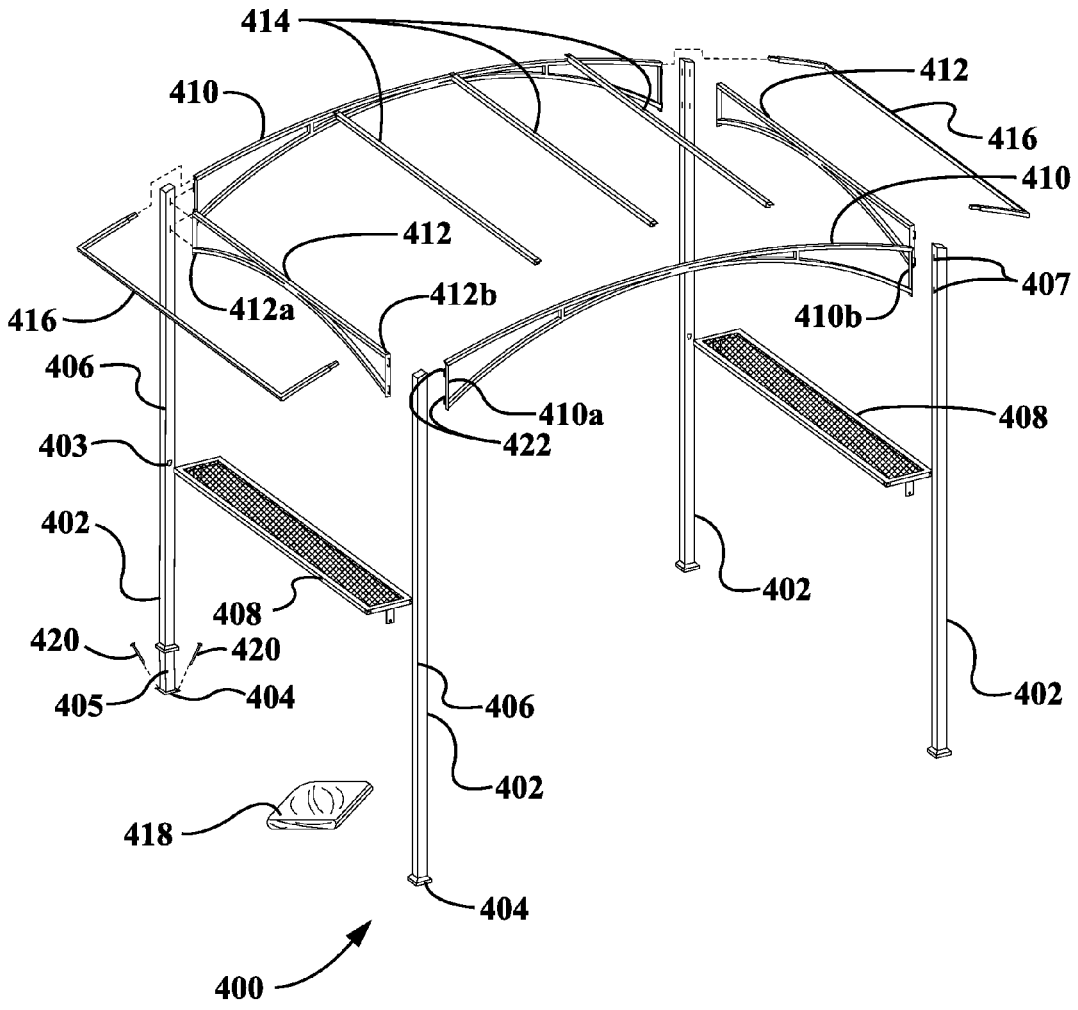
FIG. 24 is an overall exploded perspective view of a portable shelter framing system for a grill-type portable shelter, according to a seventh embodiment of the invention.

A seventh exemplary embodiment of the portable shelter or gazebo is seen generally at 400 in FIG. 24, wherein the portable shelter is in the form of a grill-type gazebo. Referring to this figure, it can be seen that, in some respects, the seventh exemplary embodiment is similar to that of the preceding six embodiments. Although, most elements of the portable shelter 400 are different from those of the preceding embodiments described herein.

As shown in FIG. 24, similar to the first embodiment, the vertical support members of the portable shelter framing system of the seventh illustrated embodiment are in the form of corner post members 402. Each corner post member 402 includes a base portion 404, a tubular body portion 406, and two pairs of elongate slots 407 that are disposed proximate to the end of the tubular body portion 406 (e.g., the top end), which is opposite to the end having the base portion 404 (e.g., the bottom end). As will be described hereinafter, each pair of elongate slots 407 is configured to engage with a corresponding pair of hook members 422 on an end of one of the crossbeam members 410, 412. The pairs of elongate slots 407 are oriented generally perpendicular to one another (i.e., on adjacent sides of the tubular body portion 406 of the corner post member 402).

As shown in FIG. 24, a generally rectangular-shaped, transverse shelf member 408 is configured to be attached between a pair of corner post members 402 on each end of the portable shelter 400. Each of the corner post members 402 is provided with an aperture 403 in a side thereof for accommodating a projection on the end of the transverse shelf member 408, or a fastener for securing the transverse shelf member 408 to the corner post member 402. In FIG. 24, it can be seen that the apertures 403 are approximately disposed in the middle of each of the corner post members 402.

Referring particularly to FIG. 24, it can be seen that each of the crossbeam members 410, 412 has opposed first and second end portions 410*a*, 410*b* and 412*a*, 412*b*. Each of the crossbeam members 410, 412 further includes a first pair of hook members 422 extending from a first end portion 410*a* or 412*a* and a second pair of hook members 422 extending from a second end portion 410*b* or 412*b*. Each hook member 422 on the crossbeam members 410, 412 engages with a respective elongate slot 407 in a corner post member 402 (i.e., each hook member 422 is inserted into a respective slot 407) so as to attach the crossbeam members 410, 412 between the corner post members 402.

Now, with reference again to FIG. 24, the roof frame members of the portable shelter framing system of the seventh illustrative embodiment will be described. The roof framing members of the portable shelter 400 include three (3) transverse roof frame members 414 and two (2) C-shaped side roof frame members 416. The transverse roof frame members 414 each engage with, and are disposed between, the crossbeam members 410. As diagrammatically represented by the dashed line in FIG. 24, end portions of the C-shaped side roof frame members 416 are inserted into receiving apertures in the ends of the crossbeam members 410. The end portions of each C-shaped side roof frame member 416 have a reduced cross-sectional area, as compared to the remainder of the C-shaped side roof frame member 416, in order to allow their insertion into the ends of the crossbeam members 410. The transverse roof frame members 414, together with the C-shaped side roof frame members 416, support the roof canopy 418 of the grill-type portable shelter or gazebo 400.

In order to securely attach the portable shelter 400 to the ground, the base portion 404 of each corner post members 402 can be provided with a plurality of apertures disposed therethrough for receiving ground spikes 420 that can be driven into the ground. Also, as illustrated in FIG. 24, at least one of the corner post members 402 can be provided with an adjustable telescoping portion 405 so as to allow the length of the corner post member 402 to be adjusted for accommodating uneven ground surfaces.

Figure 30:
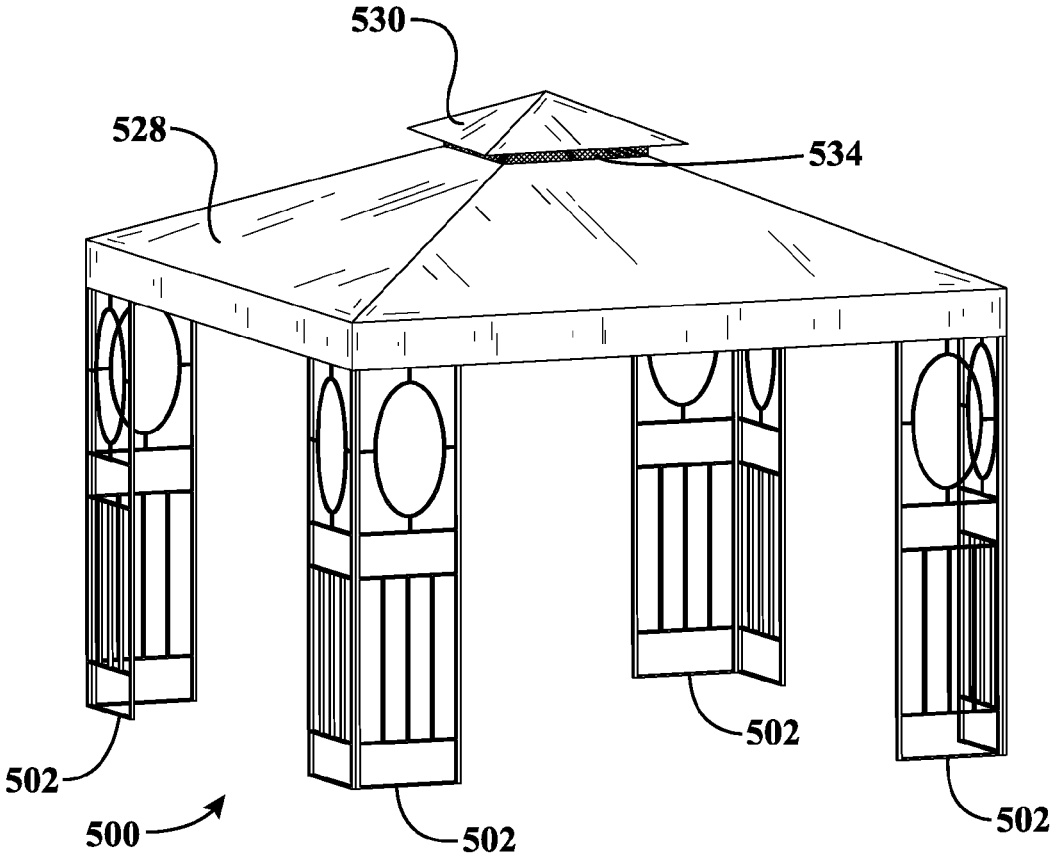
FIG. 30 is a perspective view of a portable shelter, according to an eighth embodiment of the invention, wherein the roof canopy is shown disposed on the folding corner panel-type portable shelter.
Figure 31:
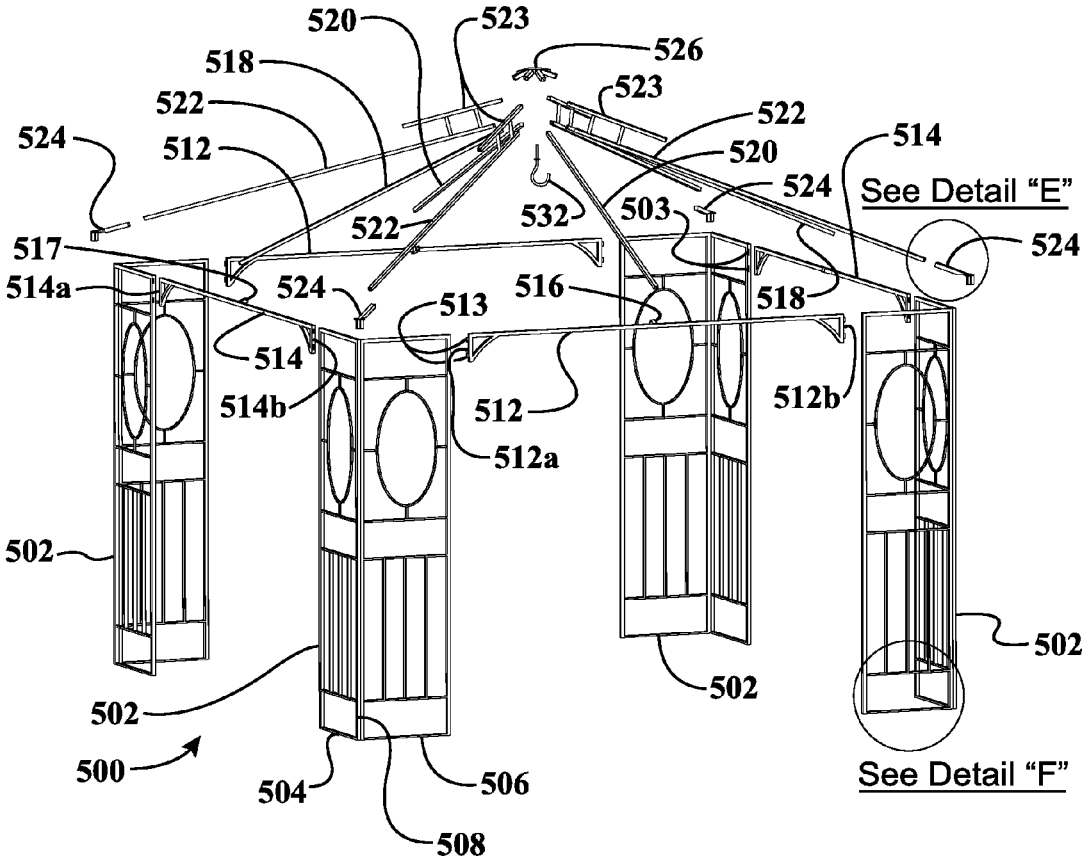
FIG. 31 is an overall exploded perspective view of the portable shelter framing system, according to the eighth embodiment of the invention.

An eighth exemplary embodiment of the portable shelter or gazebo is seen generally at 500 in FIGS. 30 and 31, and details of the eighth embodiment are shown in FIGS. 32-36. Referring to these figures, it can be seen that, in some respects, the eighth exemplary embodiment is similar to that of the third embodiment. Moreover, some elements are common to all of the embodiments. For the sake of brevity, the elements that the eighth embodiment of the portable shelter has in common with third embodiment will not be discussed at length because these components have already been explained in detail above.

Turning to FIGS. 30 and 31, it can be seen that the vertical support members of the portable shelter framing system of the eighth illustrated embodiment are in the form of folding corner frame members 502 (or folding corner panel members 502). With particular reference to FIG. 31, it can be seen that each folding corner frame member 502 includes a first panel section 504, a second panel section 506 pivotally coupled to the first panel section 504, and at least one hinge member 508 pivotally coupling the second panel section 506 to the first panel section 504. Each folding corner frame member 502 can be folded and unfolded in generally the same manner as described above with regard to FIG. 29 of the third embodiment. After the corner frame member 502 has been unfolded, the second section 506 can be locked in place relative to the first section 504 by inserting the downwardly extending tubular members 538 of the corner connector member 524 into the insert apertures 510 of the corner frame member 502 (see FIG. 34).

Figure 36:
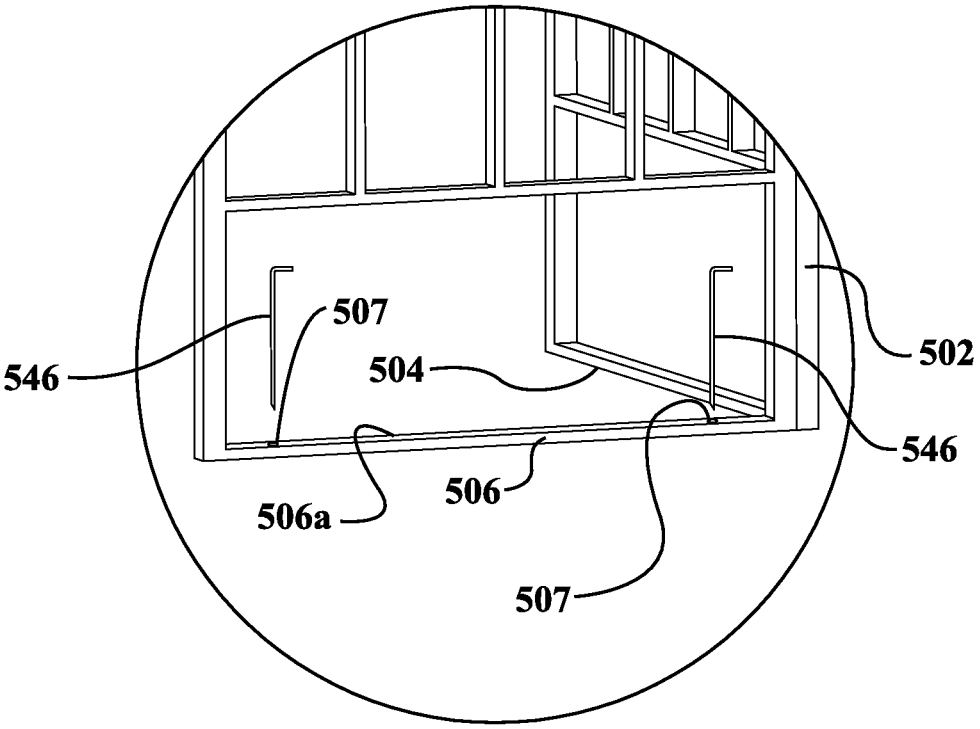
FIG. 36 is an enlarged, partial perspective view illustrating the manner in which one of the folding corner panel members of FIG. 31 is staked into the ground (Detail "F"), according to the eighth embodiment of the invention.

As shown in the detail of FIG. 36, the bottom leg 506*a* of the second section 506 of each corner frame member 502 is designed to receive a plurality of L-shaped securement stakes or spikes 546 for securely attaching the portable shelter 500 to the ground. As shown in FIG. 36, the bottom leg 506*a* of the second section 506 of the corner frame member 502 can be provided with a plurality of apertures 507 disposed therethrough for receiving securement stakes 546 that can be driven into the ground.

Figure 35:
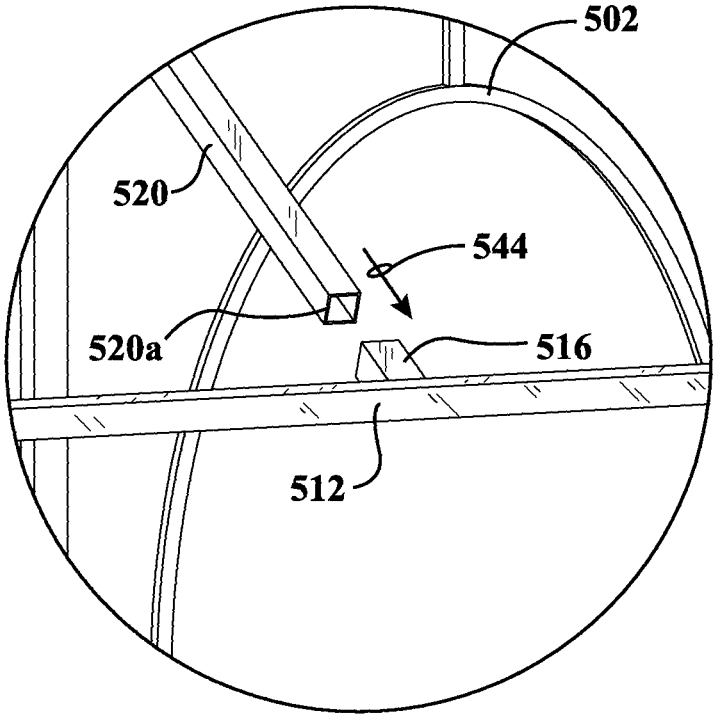
FIG. 35 is an enlarged, partial perspective view of the connection between one of the middle roof frame members and one of the crossbeam members in FIG. 31, according to the eighth embodiment of the invention.

Now, with reference again to FIG. 31, the upper frame members of the portable shelter framing system of the eighth illustrative embodiment will be described. Similar to the third and fifth embodiments described above, the portable shelter 500 comprises two sets of crossbeam members 512, 514. In general, for each of the embodiments described herein, the crossbeam members (e.g., crossbeam members 512, 514 in the present embodiment) extend in a longitudinal direction that is substantially perpendicular to the longitudinal extending direction of the vertical support members (e.g., corner frame members 502 in the present embodiment). Each of the crossbeam members 512, 514 has opposed first and second end portions or ends 512*a*, 512*b* and 514*a*, 514*b*. Like the crossbeam members 212, 214 described above in conjunction with the third embodiment, and the crossbeam members 312, 316 described above in conjunction with the fifth embodiment, each of the crossbeam members 512, 514 further includes a first pair of hook members 513 extending from a first end portion 512*a* or 514*a* and a second pair of hook members 513 extending from a second end portion 512*b* or 514*b*. Also, as shown in FIG. 31, the outer side edges of the first and second sections 504, 506 of each corner frame member 502 are provided with a pair of elongate slots 503 disposed near the top thereof. Each hook member 513 on the crossbeam members 512, 514 engages with a respective slot 503 in a corner frame member 502 (i.e., each hook member 513 is inserted into a respective slot 503) so as to attach the crossbeam members 512, 514 between the corner frame members 502. Like crossbeam members 312, 316 described above in conjunction with the fifth embodiment, each crossbeam member 512, 514 is provided with a center tubular portion bounded by triangular-shaped end portions with the hook members 513 disposed thereon. Also, each of the crossbeam members 512 is provided with a centrally located, diagonally extending roof member connector 516 for connecting to middle roof frame member 520, while each of the crossbeam members 514 is provided with a centrally located, diagonally extending roof member connector 517 for connecting to middle roof frame member 518. That is, as best shown in FIG. 35, the lower ends 520*a* of the middle roof frame members 520 engage with the diagonally extending roof member connectors 516 (i.e., the lower end portions of the middle roof frame members 520 are inserted into diagonally extending roof member connectors 516 as indicated by the arrow 544 in FIG. 35), while the lower end portions of the middle roof frame members 518 engage with the diagonally extending roof member connectors 517 (i.e., the lower end portions of the middle roof frame members 518 are inserted into diagonally extending roof member connectors 517).

Figure 32:
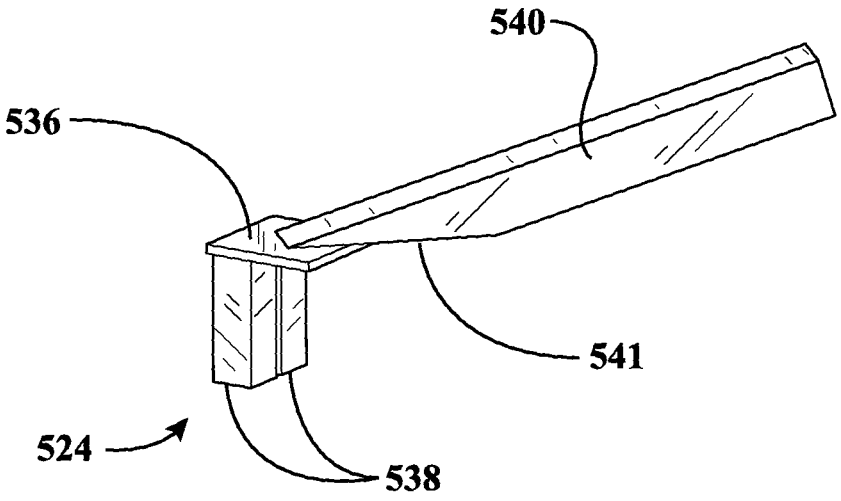
FIG. 32 is a side perspective view of one of the corner connector members of the portable shelter, according to the eighth embodiment of the invention.
Figure 33:
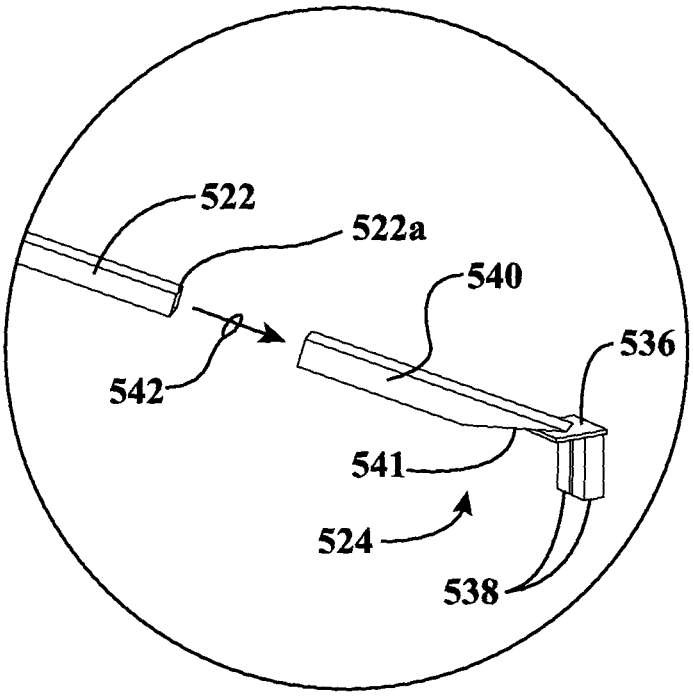
FIG. 33 is an enlarged, partial perspective view of the connection between one of the corner connector members and one of the corner roof frame members in FIG. 31 (Detail "E"), according to the eighth embodiment of the invention.
Figure 34:
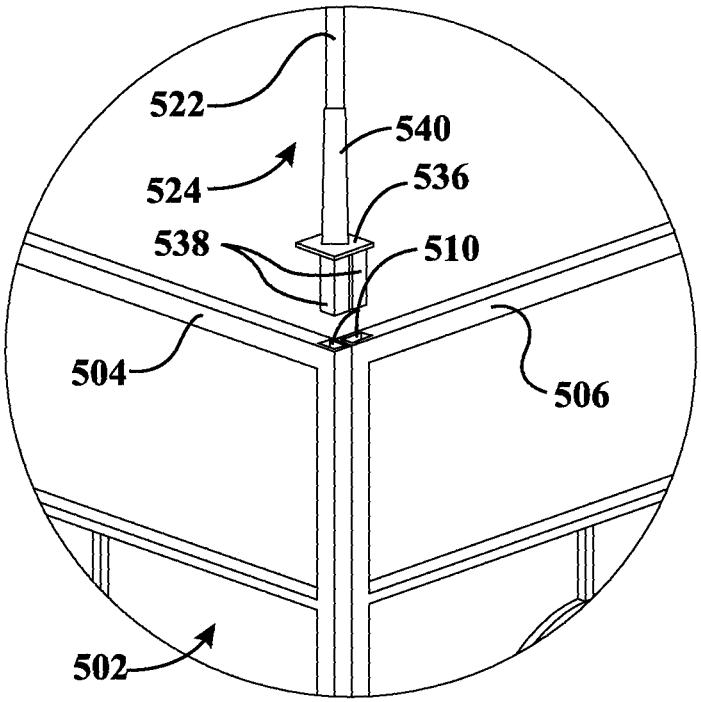
FIG. 34 is an enlarged, partial perspective view of the connection between one of the corner connector members and one of the folding corner panel members in FIG. 31, according to the eighth embodiment of the invention.

Next, turning to FIGS. 32 and 34, as briefly described above, a corner connector member 524 is provided at the top interior corner of each corner frame member 502 in order to lock its sections 504, 506 in place relative to one another. As shown in FIGS. 32 and 34, each corner connector member 524 includes a top plate 536 with a plurality of tubular members 538 (i.e., two tubular members 538) extending from the bottom surface thereof. Each tubular member 538, which has a generally square-shaped cross-section, is configured to be received within a respective generally square-shaped aperture 510 in the top surface of the corner frame member 502 (see FIG. 34). In addition to fixing the positions of the first and second sections 504, 506 of each corner frame member 502 relative to one another, each of the corner connector members 524 couples a respective corner roof frame member 522 to a respective one of the folding corner frame members 502 without the use of tools. In particular, as illustrated in FIG. 33, the lower ends 522*a* of respective corner roof frame members 522 engage with roof frame sleeves 540 of respective corner connector members 524 (i.e., the lower end portions 522*a* of the corner roof frame members 522 are inserted into the roof frame sleeves 540 of the corner connector members 524 as indicated by the arrow 542 in FIG. 33). As shown in FIGS. 32 and 33, each of the roof frame sleeves 540 comprises a diagonal side 541 disposed on the bottom thereof. The diagonal side 541 of each roof frame sleeve 540 is connected to the top surface of the top plate 536 (see e.g., FIG. 32).

Turning again to the exploded view of FIG. 31, further aspects of the roof frame members of the portable shelter framing system of the eighth illustrative embodiment will be described. In general, similar to the third embodiment described above, it can be seen that the roof frame members 518, 520, 522 are circumferentially spaced apart from one another so as to form a supporting structure for a roof canopy 528, 530 (see FIG. 30), such as that formed from a canvas covering material. In FIG. 31, it can be seen that an upper end of each of the roof frame members 518, 520, 522 is designed to be inserted into a respective outwardly extending tubular member of the central connecting member 526. As depicted in this figure, the underside of the central connecting member 526 is provided with a hook member 532 attached thereto (e.g., the end portion of the hook member 532 may be provided with a plurality of external threads that matingly engage with a plurality of internal threads on the central connecting member 526). As an example, the hook member 532 may be used for holding a hanging plant or a light inside the portable shelter 500. In the eighth illustrated embodiment, the roof framing members include the two (2) middle roof frame members 518 having a first length, the two (2) middle roof frame members 520 having a second length, the four (4) corner roof frame members 522, and the four (4) corner connector members 524. As shown in FIG. 31, the first length of the middle roof frame members 518 is greater than the second length of the middle roof frame members 520. Together, the roof frame members 518, 520, 522 support the peripheral roof canopy portion 528, while the central roof canopy portion 530, which forms the top of the roof vent (see FIG. 30), is supported on the upper tubular members 523 of the corner roof frame members 522 (refer to FIG. 31). As shown in FIG. 30, the peripheral gap between the peripheral roof canopy portion 528 and the central roof canopy portion 530 comprises a netted roof opening 534 for venting warm air from the interior of the portable shelter 500.

Figure 37:
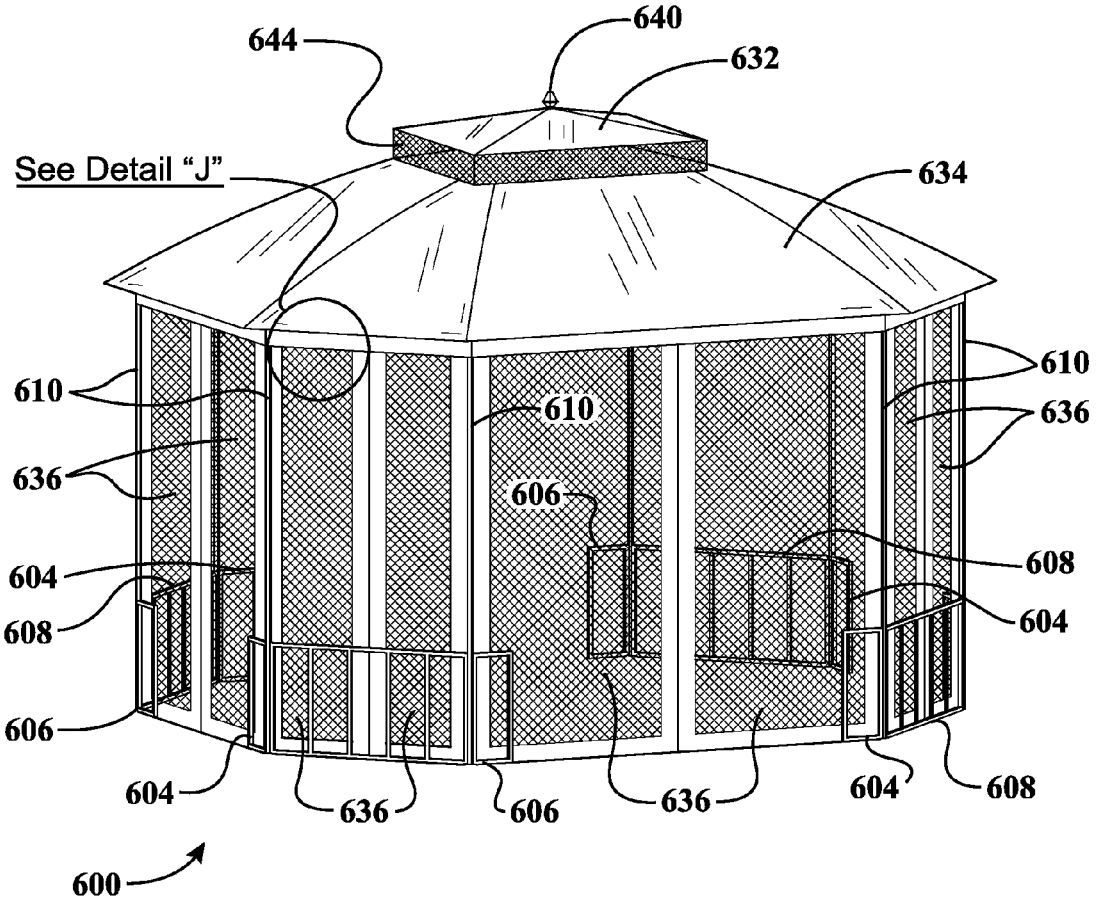
FIG. 37 is a perspective view of a portable shelter, according to a ninth embodiment of the invention, wherein the roof canopy is shown disposed on the octagonal-type portable shelter.
Figure 38:
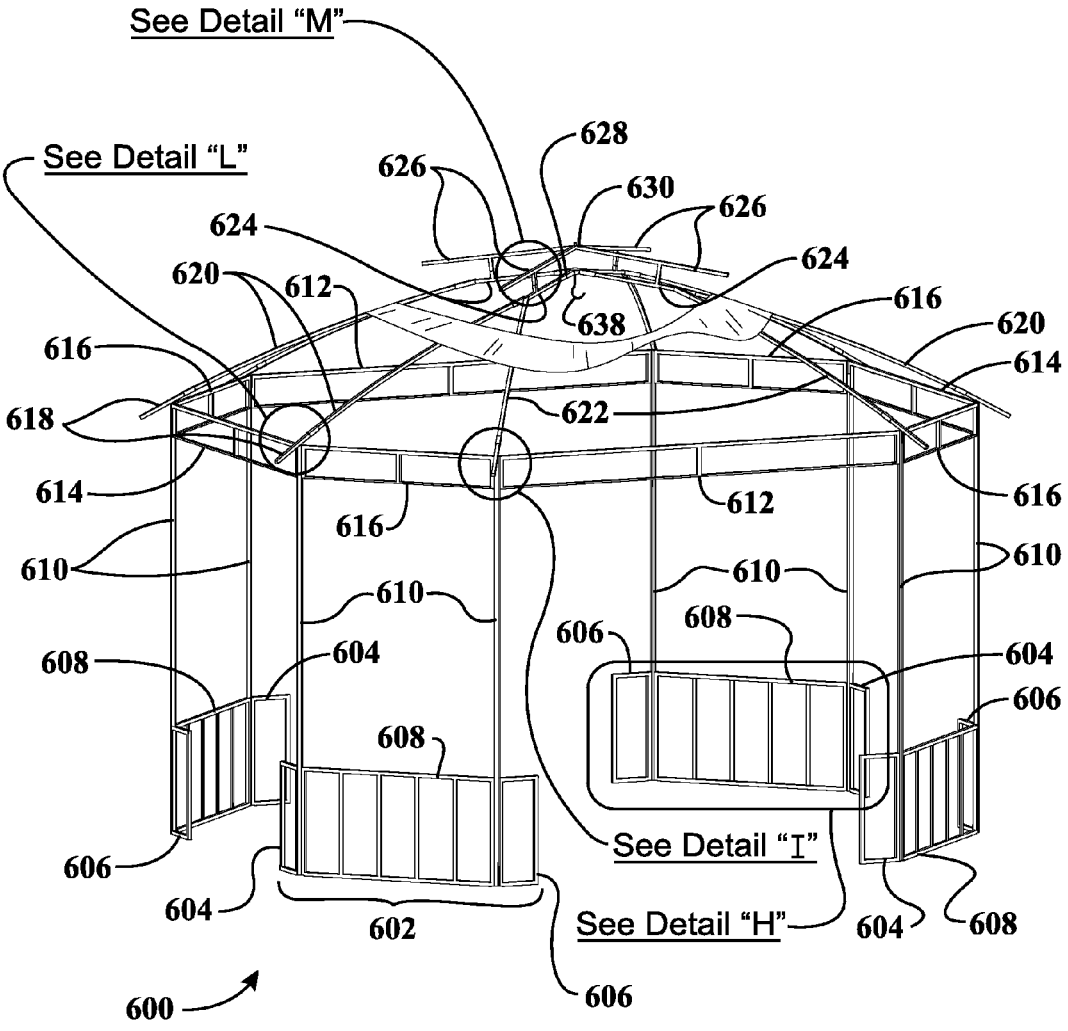
FIG. 38 is another perspective view of the portable shelter, according to the ninth embodiment of the invention, wherein the side panels, the peripheral roof canopy portion, and the central roof canopy portion have all been generally removed from the portable shelter to better illustrate the framing system thereof.
Figure 39:
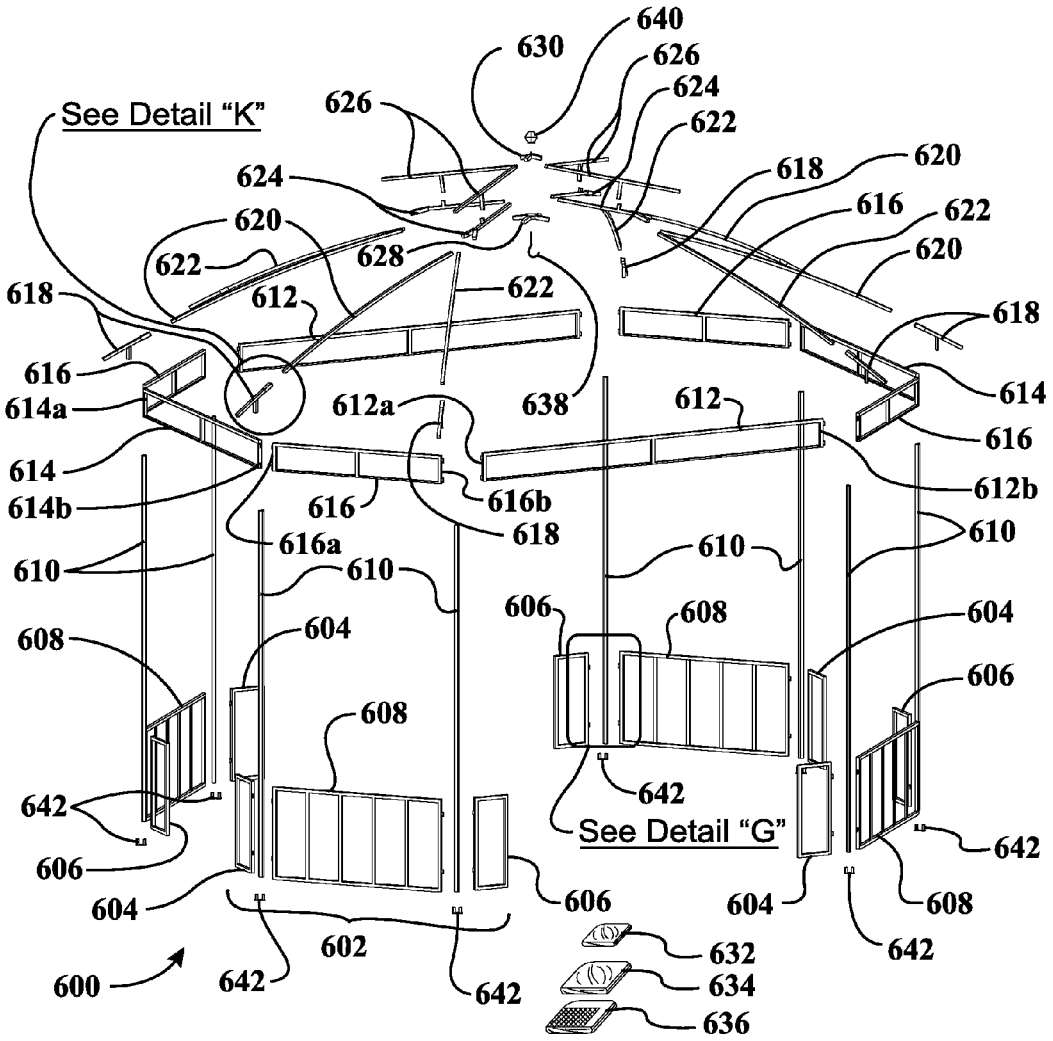
FIG. 39 is an overall exploded perspective view of the portable shelter framing system, according to the ninth embodiment of the invention.

A ninth exemplary embodiment of the portable shelter or gazebo is seen generally at 600 in FIGS. 37-39, and details of the ninth embodiment are shown in FIGS. 40-49. Referring to these figures, it can be seen that, in some respects, the ninth exemplary embodiment is similar to that of the fifth embodiment described above. In addition, some elements are similar to the previously described embodiments. For the sake of brevity, the elements that the ninth embodiment of the portable shelter has in common with preceding embodiments described herein will not be discussed at length because these components have already been explained in detail above.

Figure 43:
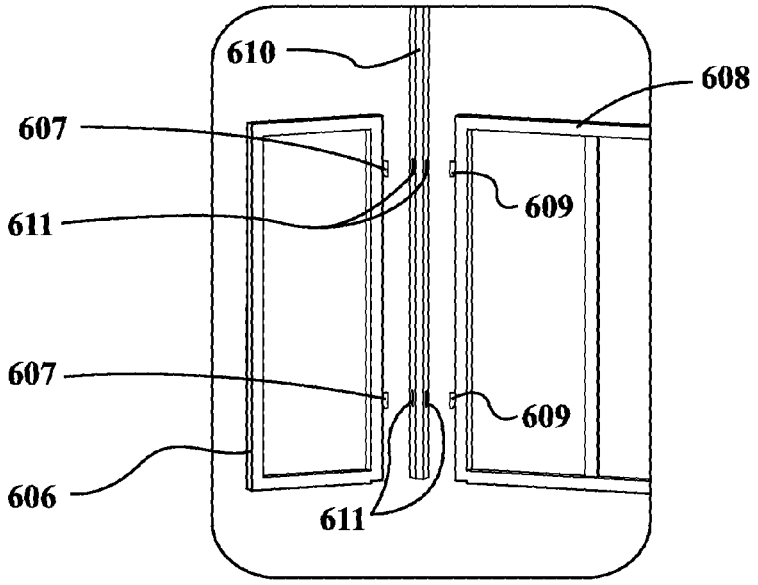
FIG. 43 is an enlarged, partial perspective view of the connection between one of the support post members and the adjoining corner fence sections in FIG. 39 (Detail "G"), according to the ninth embodiment of the invention.
Figure 44:
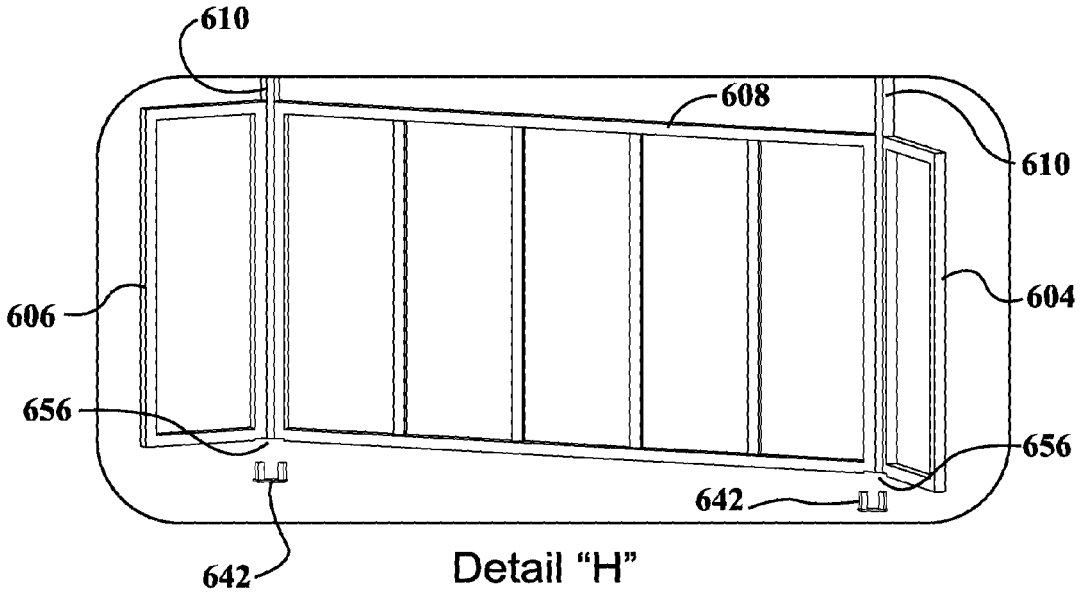
FIG. 44 is an enlarged, partial perspective view illustrating the manner in which adjacent corner fence sections are connected by bottom fence connecting members in FIG. 39 (Detail "H"), according to the ninth embodiment of the invention.

Turning to FIGS. 38 and 39, it can be seen that the vertical support members of the portable shelter framing system of the ninth illustrated embodiment are in the form of corner fence assemblies 602, each comprising two spaced apart, support post members 610. With reference to FIGS. 38, 39, 43, and 44, it can be seen that each corner fence assembly 602 includes a first side fence section 604, a second side fence section 606, a center fence section 608, and two (2) support post members 610. As best shown in the detail view of FIG. 43, each of the first and second side fence sections 604, 606 comprises a plurality of hook members 607 disposed on one side thereof. Similarly, the center fence section 608 comprises a plurality of hook members 609 disposed on opposed sides thereof. In FIG. 43, it can be seen that each of the hook members 607 of the first and second side fence sections 604, 606 engages with a respective elongate slot 611 in a side of a support post member 610 (i.e., each hook member 607 is inserted into a respective elongate slot 611) so as to attach the first and second side fence sections 604, 606 to respective support post members 610. Also, as shown in FIG. 43, each of the hook members 609 of the center fence section 608 engages with a respective elongate slot 611 in a side of a support post member 610 that is disposed generally opposite to the side in which the hook members 607 of the side fence section 604, 606 engage (i.e., each hook member 609 is inserted into a respective elongate slot 611) so as to attach the center fence section 608 between two (2) spaced apart, support post members 610. Additionally, as shown in FIG. 44, each of the first and second side fence sections 604, 606 are attached to the center fence section 608 at the bottom edges thereof by corner fence connecting members 642. In particular, with reference to FIG. 41, it can be seen that each corner fence connecting member 642 comprises a base plate 646 with two (2) spaced-apart tubular members 648 extending upward therefrom. One of the tubular members 648 of the fence connecting member 642 engages with an aperture disposed in the bottom corner of a side fence section 604, 606, while the other one of the tubular members 648 of the fence connecting member 642 engages with an aperture disposed in the bottom corner of a center fence section 608 (i.e., the tubular members 648 of each fence connecting member 642 are inserted into respective apertures in the bottom surfaces of one of the side fence sections 604, 606 and the center fence section 608, respectively). As shown in FIG. 44, the adjacent corners of each side fence section 604, 606 and the center fence section 608 are provided with a notch 656 disposed therein for accommodating the thickness of the base plate 646 of each fence connecting member 642 so that the bottom surface of the base plate 646 of the fence connecting member 642 lies generally flush with the bottom surfaces of the side fence sections 604, 606 and the center fence section 608.

Figure 45:
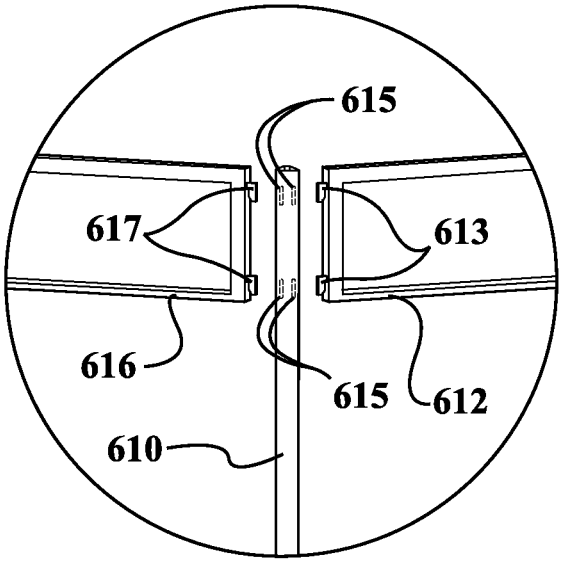
FIG. 45 is an enlarged, partial perspective view of the connection between one of the support post members and the adjoining crossbeam members in FIG. 38 (Detail "I"), according to the ninth embodiment of the invention.
Figure 46:
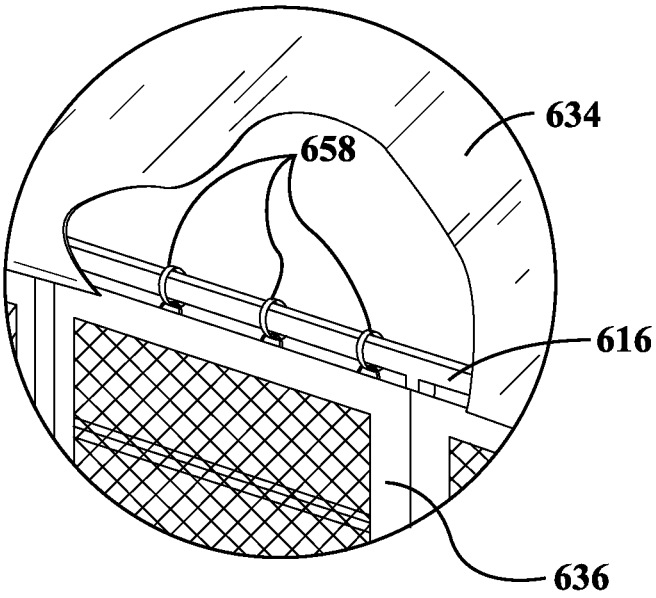
FIG. 46 is an enlarged, partial perspective view of the connection between one of the netted side curtain panels and one of the crossbeam members in FIG. 37 (Detail "J"), according to the ninth embodiment of the invention.
Figure 47:
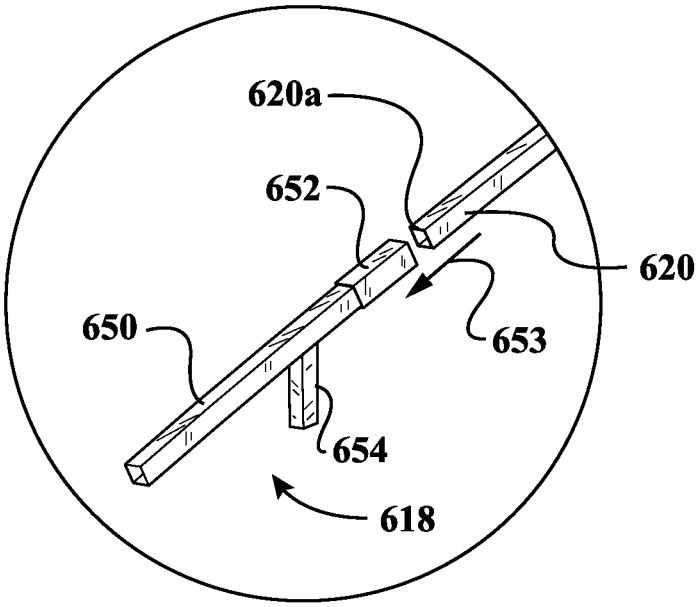
FIG. 47 is an enlarged, partial perspective view of the connection between one of the roof frame extension members and one of the arched roof frame members in FIG. 39 (Detail "K"), according to the ninth embodiment of the invention.
Figure 48:
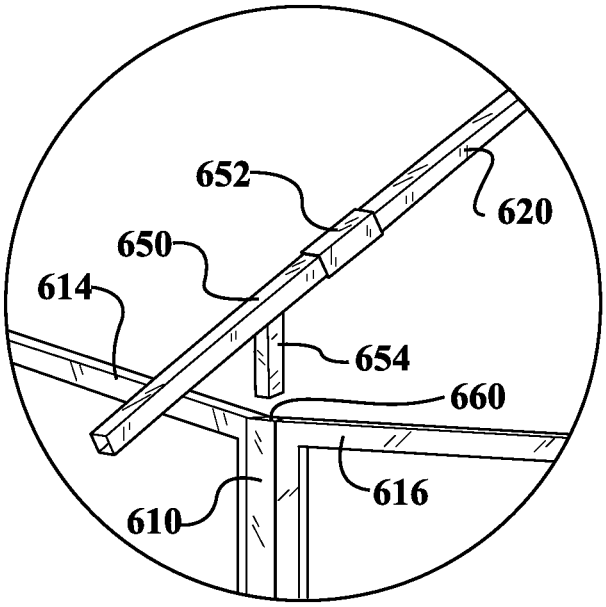
FIG. 48 is an enlarged, partial perspective view of the connection between one of the roof frame extension members and one of the support post members in FIG. 38 (Detail "L"), according to the ninth embodiment of the invention.

Now, with reference again to FIGS. 38 and 39, the upper frame members of the portable shelter framing system of the ninth illustrative embodiment will be described. Similar to the third embodiment described above, the portable shelter 600 comprises a plurality of crossbeam members 612, 614, 616. Like the crossbeam members 212, 214 of the third embodiment, the crossbeam members 612, 614, 616 are generally in the form of non-folding, generally linear beams with an outer rectangular tubular frame that is bisected by a center tubular member in the middle of the frame. As shown in FIG. 39, it can be seen that each of the crossbeam members 612, 614, 616 has opposed first and second end portions 612*a*, 612*b*, 614*a*, 614*b*, and 616*a*, 616*b*, respectively. Also, as depicted in FIG. 39, similar to the third and fourth embodiments, each of the crossbeam members 612 and 616 further includes a first pair of hook members 613, 617 extending from a first end portion 612*a* or 616*a* and a second pair of hook members 613, 617 extending from a second end portion 612*b* or 616*b* (see e.g., FIGS. 42 and 45). Similarly, each of the crossbeam members 614 further includes a first pair of hook members extending from a first end portion 614*a* and a second pair of hook members extending from a second end portion 614*b* thereof. Turning to FIG. 45, it can be seen that opposed sides of each support post member 610 are provided with a pair of spaced apart, elongate slots 615 disposed near the top thereof. In FIG. 45, it can be seen that each hook member 613, 617 on the crossbeam members 612, 616 engages with a respective slot 615 in an opposed side of the support post member 610 (i.e., each hook member 613, 617 is inserted into a respective slot 615) so as to attach the crossbeam members 612, 616 between the support post members 610. Similarly, each hook member on the crossbeam members 614 engage with a respective slot 615 in an opposed side of the support post member 610 (i.e., each hook member is inserted into a respective slot 615) so as to attach the crossbeam members 614 between the support post members 610.

Now, with reference again to FIGS. 38 and 39, the roof frame members of the portable shelter framing system of the ninth illustrative embodiment will be described. In general, similar to the preceding embodiments described above, it can be seen that the roof frame members 620, 622 are circumferentially spaced apart from one another so as to form a supporting structure for a roof canopy 632, 634 (see FIG. 37), such as that formed from a canvas covering material. As best shown in FIG. 39, an upper end of each of the roof frame members 620, 622 is designed to be indirectly coupled to an outwardly extending tubular member of a lower central connecting member 628 by means of a beam connecting member 624. In FIG. 39, it can be seen that each Y-shaped beam connecting member 624 has branched tubular portions, which are designed to engage with upper end portions of respective roof frame members 620, 622 (i.e., the upper end portion of each roof frame member 620, 622 is inserted into a respective branched tubular portion of a beam connecting member 624).

Figure 49:
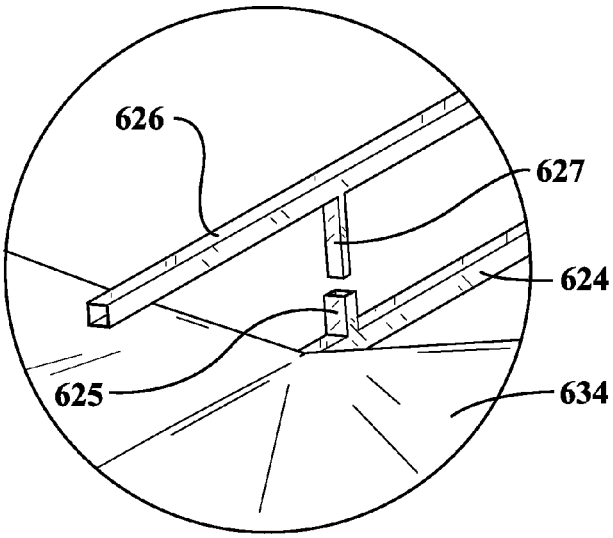
FIG. 49 is an enlarged, partial perspective view of the connection between one of the beam connecting members and one of the roof vent frame members in FIG. 38 (Detail "M"), according to the ninth embodiment of the invention.

Next, referring primarily to FIGS. 39 and 49, the engagement between each beam connecting member 624 and its associated top frame member 626 will be explained. In the detail view of FIG. 49, it can be seen that the beam connecting member 624 comprises an upwardly extending tubular portion 625 for engaging a downwardly extending tubular portion 627 of the top frame member 626 (i.e., each downwardly extending tubular portion 627 of the top frame member 626 is inserted into a respective open end of the upwardly extending tubular portion 625 of the beam connecting member 624). As shown in FIG. 38, in the assembled state, the top frame member 626 is spaced apart from the beam connecting member 624 by the upwardly extending tubular portion 625 and the downwardly extending tubular portion 627, thereby forming the gap for the roof vent of portable shelter 600. With combined reference to FIGS. 38 and 39, it can be seen that an upper end of each of the top frame members 626 is designed to be coupled to an outwardly extending tubular member of an upper central connecting member 630. Also, in FIGS. 37 and 39, it can be seen that a finial member 640 is provided at the central peak of the central roof canopy portion 632 to hold the canopy portion 632 in place. For example, the finial member 640 may be attached to the upper central connecting member 630 by a suitable fastener.

Figure 40:
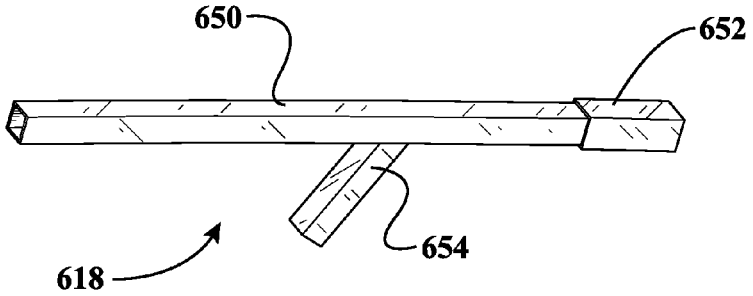
FIG. 40 is a side perspective view of one of the roof frame extension members of the portable shelter, according to the ninth embodiment of the invention.
Figure 41:
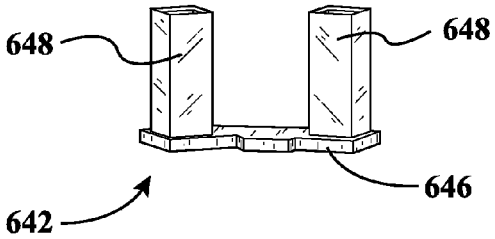
FIG. 41 is a side perspective view of one of the bottom fence connecting members of the portable shelter, according to the ninth embodiment of the invention.
Figure 42:
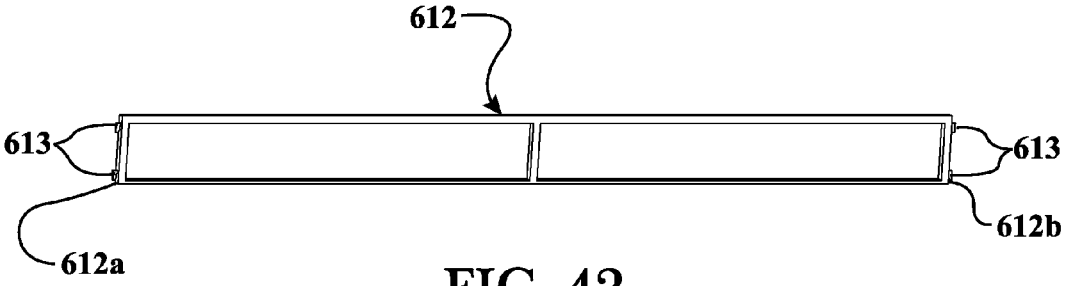
FIG. 42 is a side perspective view of one of the crossbeam members of the portable shelter, according to the ninth embodiment of the invention.

With reference to FIGS. 38-40 and 47-48, the manner in which the lower ends of the roof frame members 620, 622 are connected to the other members of the portable shelter framing system will now be described. Initially, as shown in the detail view of FIG. 47, the lower end portions 620*a* of the each roof frame member 620 is designed to engage with a collar portion 652 of a roof frame extension member 618 (i.e., the lower end portions 620*a* of the corner roof frame members 620 are inserted into respective collar portions 652 of the roof frame extension members 618 as indicated by the arrow 653 in FIG. 47) Like the roof frame members 620, the lower end portions of each roof frame member 622 is also designed to engage with a collar portion 652 of a roof frame extension member 618 (i.e., the lower end portions of the corner roof frame members 622 are inserted into respective collar portions 652 of the roof frame extension members 618 in the same manner illustrated for the roof frame member 620 in FIG. 47). Also, as shown in FIG. 40, each roof frame extension member 618 further comprises a linear body portion 650 with a downwardly extending portion 654. Turning to the detail view of FIG. 48, it can be seen that the downwardly extending portion 654 of each roof frame extension member 618 is configured to be received within a respective aperture 660 in a top end of the support post members 610 (i.e., each downwardly extending end portion 654 is inserted into an aperture 660 at a top end of a respective support post member 610). In this manner, the roof frame extension members 618 couple respective roof frame members 620, 622 to respective support post members 610.

Turning again to FIG. 37, the exterior coverings and other features of the portable shelter 600 of the ninth embodiment will now be described. Similar to that described above in conjunction with one or more of the preceding embodiments, such as the first embodiment, a peripheral roof canopy portion 634 is configured to cover a majority of the roof framing system, while a central roof canopy portion 632 is configured to be disposed over the top frame members 626 that partially form the roof vent of the portable shelter 600. Together the peripheral roof canopy portion 634 and the central roof canopy portion 632 form the roof of the portable shelter 600. In FIGS. 38 and 39, it can be seen that the underside of the bottom central connecting member 628 is provided with a hook member 638 attached thereto (e.g., the end portion of the hook member 638 may be provided with a plurality of external threads that matingly engage with a plurality of internal threads on the bottom central connecting member 628). The hook member 638 may be used for the same purposes described above for the preceding embodiments, such the first and eighth embodiments. As shown in FIG. 37, the sides of the portable shelter 600 are configured to be covered with netted side curtain panels 636 that are designed to permit airflow therethrough, yet keep insects from entering the interior of the portable shelter 600. In the detail view of FIG. 46, it can be seen that each netted side curtain panel 636 may be connected to the upper frame portion of a crossbeam member 616 (or 612, 614) by a plurality of spaced apart, curtain support rings 658. As additionally illustrated in FIG. 37, it can be seen that the peripheral gap between the peripheral roof canopy portion 634 and the central roof canopy portion 632 comprises a netted roof opening 644 for venting warm air from the interior of the portable shelter 600.

It is readily apparent that the aforedescribed portable shelters 100, 100', 200, 200', 300, 300', 400, 500, 600 offer numerous advantages. First, each of the portable shelters 100, 100', 200, 200', 300, 300', 400, 500, 600 incorporate a framing system that can be quickly and easily assembled and disassembled each time that it is used. Secondly, each of the portable shelters 100, 100', 200, 200', 300, 300', 400, 500, 600 utilize a portable shelter framing system that is capable of being assembled and disassembled without the use of any tools. Finally, each of the portable shelters 100, 100', 200, 200', 300, 300', 400, 500, 600 described herein employ a portable shelter framing system that is capable of being disassembled into a plurality of compact components that do not occupy a large amount of space when the portable shelter is transported and stored.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A portable shelter framing system comprising, in combination:

a plurality of folding corner frame members, at least one of said plurality of folding corner frame members including a first panel section pivotally coupled to a second panel section by means of at least one hinge member, said at least one hinge member having a pivotal axis extending in a lengthwise direction of said at least one of said plurality of folding corner frame members;

a plurality of crossbeam members, each of said crossbeam members configured to be connected between a pair of said plurality of folding corner frame members without the use of tools, and each of said crossbeam members having a center beam portion bounded by triangular-shaped end portions; and a plurality of roof frame members, said plurality of roof frame members including a first subset of corner roof frame members and a second subset of middle roof frame members, each of said corner roof frame members configured to be coupled to one of said plurality of folding corner frame members without the use of tools, each of said middle roof frame members configured to be coupled to one of said plurality of crossbeam members without the use of tools, and one or more of said corner roof frame members including an upper frame portion spaced apart from a lower frame portion by one or more vertical frame portions, said upper frame portion configured to support a roof vent cover of said portable shelter.

2. The portable shelter framing system according to claim 1, further comprising one or more shelf members, each of said one or more shelf members configured to be coupled to a respective one of said plurality of folding corner frame members without the use of tools.

3. The portable shelter framing system according to claim 1, further comprising a plurality of corner connector members, each of said plurality of corner connector members configured to couple a respective one of said plurality of corner roof frame members to a respective one of said plurality of folding corner frame members.

4. The portable shelter framing system according to claim 3, wherein each of said plurality of corner connector members comprises a roof frame sleeve for receiving an end portion of a respective one of said corner roof frame members.

5. The portable shelter framing system according to claim 3, wherein each of said plurality of corner connector members comprises one or more downwardly extending members, and each of said plurality of folding corner frame members comprises an aperture disposed in a top surface thereof; and wherein each said aperture in said top surface of a respective one of said plurality of folding corner frame members is configured to receive a respective one of said one or more downwardly extending members of each said corner connector member.

6. The portable shelter framing system according to claim 1, wherein one or more of said plurality of crossbeam members comprises a roof frame connector member for receiving an end portion of a respective one of said middle roof frame members.

7. The portable shelter framing system according to claim 6, wherein said roof frame connector member diagonally extends from a side of said center beam portion of said crossbeam member.

8. The portable shelter framing system according to claim 1, wherein each of said triangular-shaped end portions of said plurality of crossbeam members has one or more hook members disposed on respective outer sides thereof;

wherein each of said plurality of folding corner frame members has outer side edges with one or more respective slots disposed therein; and wherein each of said one or more hook members is configured to engage with a respective one of said one or more slots in one of said outer side edges of said folding corner frame member.

9. The portable shelter framing system according to claim 8, wherein said one or more hook members comprise a pair of hook members vertically spaced apart on said outer sides of said triangular-shaped end portions of said plurality of crossbeam members, and wherein said one or more respective slots comprise a pair of respective slots disposed on said outer side edges of said folding corner frame members.

10. The portable shelter framing system according to claim 1, wherein said second panel section of said at least one of said plurality of folding corner frame members is configured to rotate approximately 90 degrees relative to said first panel section from a folded position to an unfolded position.

11. A portable shelter framing system comprising, in combination:

a plurality of corner support assemblies, at least one of said plurality of corner support assemblies having a top surface with one or more apertures disposed in said top surface;

a plurality of crossbeam members, at least some of said crossbeam members configured to be connected between a pair of said plurality of corner support assemblies without the use of tools;

a plurality of roof frame members, said plurality of roof frame members including a first subset of corner roof frame members and a second subset of middle roof frame members, each of said corner roof frame members configured to be coupled to one of said plurality of corner support assemblies without the use of tools, each of said middle roof frame members configured to be coupled to one of said plurality of crossbeam members without the use of tools, and one or more of said corner roof frame members including an upper frame portion spaced apart from a lower frame portion by one or more vertical frame portions, said upper frame portion configured to support a roof vent cover of said portable shelter; and at least one corner connector member, said at least one corner connector member configured to couple one of said corner roof frame members to said at least one of said plurality of corner support assemblies, said at least one corner connector member including a plate member with one or more downwardly extending members extending from a bottom surface of said plate member, said one or more downwardly extending members of said at least one corner connector member configured to be inserted into respective ones of said one or more apertures disposed in said top surface of said at least one of said plurality of corner support assemblies.

12. The portable shelter framing system according to claim 11, wherein said one or more apertures disposed in said top surface of said at least one of said plurality of corner support assemblies comprise a plurality of spaced-apart apertures disposed in said top surface, and said one or more downwardly extending members of said at least one corner connector member comprise a plurality of downwardly extending members, each of said plurality of spaced-apart apertures configured to receive a respective one of said plurality of said downwardly extending members of said at least one corner connector member.

13. The portable shelter framing system according to claim 12, wherein each of said plurality of corner support assemblies comprises a center section and folding side sections disposed on opposite sides of said center section, each of said folding side sections configured to fold against said center section for compact storage of said portable shelter framing system.

14. The portable shelter framing system according to claim 13, wherein each of said spaced apart apertures is generally disposed at a location where one of said folding side sections adjoins said center section.

15. The portable shelter framing system according to claim 12, wherein each of said plurality of corner support assemblies comprises a pair of spaced apart support posts.

16. The portable shelter framing system according to claim 15, wherein each of said spaced apart apertures is disposed in an upper end of a respective one of said spaced apart support posts.

17. The portable shelter framing system according to claim 15, wherein each of said plurality of corner support assemblies further comprises a center fence section and side fence sections disposed on opposite sides of said center fence section, each of said center fence section and said side fence sections configured to be coupled to said spaced apart support posts without the use of tools.

18. The portable shelter framing system according to claim 12, wherein said at least one of said plurality of corner support assemblies is in the form of a folding corner frame member that includes a first panel section pivotally coupled to a second panel section, and wherein said plurality of downwardly extending members of said at least one corner connector member are configured to lock said second panel section of said folding corner frame member in place relative to said first panel section.

19. A portable shelter framing system comprising, in combination:

a plurality of corner support members;

a plurality of crossbeam members, each of said crossbeam members configured to be connected between a pair of said plurality of corner support members without the use of tools;

a plurality of roof frame members, each of said roof frame members configured to be circumferentially spaced apart from one another so as to form a supporting structure for a roof material, said plurality of roof frame members including a first subset of corner roof frame members and a second subset of middle roof frame members, and one or more of said corner roof frame members including an upper frame portion spaced apart from a lower frame portion by one or more vertical frame portions, said upper frame portion configured to support a roof vent cover of said portable shelter;

a plurality of corner connecting members, said plurality of corner connecting members configured to couple respective ones of said corner roof frame members to respective ones of said plurality of corner support members without the use of tools, at least one of said plurality of corner connecting members including a plate member with a diagonally-oriented roof frame sleeve extending from a top surface of said plate member, said roof frame sleeve configured to receive an end portion of one of said corner roof frame members, a bottom surface of said plate member configured to be disposed against a top surface of one of said plurality of corner support members; and a plurality of middle connecting members, said plurality of middle connecting members configured to couple respective ones of said middle roof frame members to respective ones of said plurality of crossbeam members without the use of tools, at least one of said plurality of middle connecting members having a sleeve that extends diagonally from a side of one of said plurality of crossbeam members, said sleeve of said at least one of said plurality of middle connecting members configured to receive an end portion of one of said plurality of middle roof frame members.

20. The portable shelter framing system according to claim 19, wherein said roof frame sleeve of said at least one of said plurality of corner connecting members includes a diagonal side disposed on a bottom of said roof frame sleeve, said diagonal side of said roof frame sleeve being connected to said top surface of said plate member of said at least one of said plurality of corner connecting members, said diagonal side of said roof frame sleeve bounding a reduced cross-sectional area portion of said roof frame sleeve.

* * * * *